US010522897B1

(12) United States Patent
Katko et al.

(10) Patent No.: US 10,522,897 B1
(45) Date of Patent: Dec. 31, 2019

(54) THERMAL COMPENSATION FOR A HOLOGRAPHIC BEAM FORMING ANTENNA

(71) Applicant: Pivotal Commware, Inc., Kirkland, WA (US)

(72) Inventors: Alexander Remley Katko, Seattle, WA (US); Melroy Machado, Seattle, WA (US); Eric James Black, Bothell, WA (US); Jay Howard McCandless, Alpine, CA (US); Brian Mark Deutsch, Issaquah, WA (US)

(73) Assignee: Pivotal Commware, Inc., Kirkland, WA (US)

( * ) Notice: Subject to any disclaimer, the term of this patent is extended or adjusted under 35 U.S.C. 154(b) by 0 days.

(21) Appl. No.: 16/268,469

(22) Filed: Feb. 5, 2019

(51) Int. Cl.
*H01Q 1/02* (2006.01)
*H01Q 1/36* (2006.01)

(52) U.S. Cl.
CPC ..... *H01Q 1/02* (2013.01); *H01Q 1/364* (2013.01)

(58) Field of Classification Search
CPC ..... H01Q 3/00; H01Q 25/00
See application file for complete search history.

(56) References Cited

U.S. PATENT DOCUMENTS 6,133,880 A 10/2000 Grangeat et al.
7,205,949 B2 4/2007 Turner
9,356,356 B2 5/2016 Chang et al.
9,385,435 B2 7/2016 Bily et al.
9,450,310 B2 9/2016 Bily et al.
9,551,785 B1 1/2017 Geer
9,711,852 B2 7/2017 Chen et al.
9,806,414 B2 10/2017 Chen et al.
(Continued)

FOREIGN PATENT DOCUMENTS

CN 106797074 A 5/2017
KR 10 2016 011310 A 9/2016
(Continued)

OTHER PUBLICATIONS

Office Communication for U.S. Appl. No. 16/136,119 dated Mar. 15, 2019, pp. 1-12.
(Continued)

*Primary Examiner* — Mohamed Charioui
*Assistant Examiner* — Catherine T. Rastovski
(74) *Attorney, Agent, or Firm* — John W. Branch; Lowe Graham Jones PLLC

(57) ABSTRACT

The invention compensates for abnormal operating temperatures and/or abnormal behaviors of a holographic metasurface antenna (HMA) that is generating a beam based on a holographic function. The HMA is characterized with different holographic functions for a plurality of operating temperatures and a plurality of behaviors during the manufacturing process. The characterization of the HMA identifies different hologram functions that cause the HMA to generate more or less heat or exhibit more or less abnormal behavior while generating equivalent beams. Further, or more characterizations of a hologram function may be performed remotely after the HMA is installed in a real world environment. An operating temperature and/or a temperature gradient may be detected by temperature sensors physically located on a circuit board for the HMA.

18 Claims, 11 Drawing Sheets

(56) References Cited

U.S. PATENT DOCUMENTS

| | | | | |
|---|---|---|---|---|
| 9,806,415 | B2 | 10/2017 | Chen et al. | |
| 9,806,416 | B2 | 10/2017 | Chen et al. | |
| 9,812,779 | B2 | 11/2017 | Chen et al. | |
| 10,033,109 | B1 | 7/2018 | Gummalla et al. | |
| 10,225,760 | B1 | 3/2019 | Black | |
| 2002/0196185 | A1 | 12/2002 | Bloy | |
| 2005/0237265 | A1 | 10/2005 | Durham et al. | |
| 2008/0181328 | A1 | 7/2008 | Harel et al. | |
| 2009/0207091 | A1 | 8/2009 | Anagnostou et al. | |
| 2010/0302112 | A1 | 12/2010 | Lindenmeier et al. | |
| 2012/0194399 | A1* | 8/2012 | Bily | H01Q 13/28 343/772 |
| 2014/0171811 | A1 | 6/2014 | Lin et al. | |
| 2014/0293904 | A1 | 10/2014 | Dai et al. | |
| 2015/0109178 | A1 | 4/2015 | Hyde et al. | |
| 2015/0116153 | A1 | 4/2015 | Chen et al. | |
| 2015/0162658 | A1 | 6/2015 | Bowers et al. | |
| 2015/0222021 | A1 | 8/2015 | Stevenson et al. | |
| 2015/0276926 | A1 | 10/2015 | Bowers et al. | |
| 2015/0276928 | A1 | 10/2015 | Bowers et al. | |
| 2015/0288063 | A1 | 10/2015 | Johnson et al. | |
| 2015/0318618 | A1 | 11/2015 | Chen et al. | |
| 2015/0372389 | A1 | 12/2015 | Chen et al. | |
| 2016/0037508 | A1 | 2/2016 | Sun | |
| 2016/0149308 | A1 | 5/2016 | Chen et al. | |
| 2016/0149309 | A1 | 5/2016 | Chen et al. | |
| 2016/0149310 | A1 | 5/2016 | Chen et al. | |
| 2016/0164175 | A1 | 6/2016 | Chen et al. | |
| 2016/0241367 | A1 | 8/2016 | Irmer et al. | |
| 2016/0345221 | A1 | 11/2016 | Axmon et al. | |
| 2017/0127295 | A1 | 5/2017 | Black et al. | |
| 2017/0127332 | A1 | 5/2017 | Axmon et al. | |
| 2017/0155193 | A1 | 6/2017 | Black et al. | |
| 2017/0187123 | A1 | 6/2017 | Black et al. | |
| 2017/0187426 | A1 | 6/2017 | Su et al. | |
| 2017/0238141 | A1 | 8/2017 | Lindoff et al. | |
| 2017/0339575 | A1 | 11/2017 | Kim et al. | |
| 2018/0027555 | A1 | 1/2018 | Kim et al. | |
| 2018/0066991 | A1 | 3/2018 | Mueller et al. | |
| 2018/0233821 | A1* | 8/2018 | Pham | H01Q 3/267 |
| 2018/0270729 | A1 | 9/2018 | Ramachandra et al. | |
| 2018/0337445 | A1* | 11/2018 | Sullivan | H01Q 21/064 |

FOREIGN PATENT DOCUMENTS

| | | | |
|---|---|---|---|
| WO | 2015196044 | A1 | 12/2015 |
| WO | 2017014842 | A1 | 1/2017 |

OTHER PUBLICATIONS

U.S. Appl. No. 14/510,947, filed Oct. 9, 2014, pp. 1-76.
Office Communication for U.S. Appl. No. 15/925,612 dated Jun. 15, 2018, pp. 1-12.
Office Communication for U.S. Appl. No. 15/870,758 dated Oct. 1, 2018, pp. 1-19.
Office Communication for U.S. Appl. No. 16/049,630 dated Oct. 4, 2018, pp. 1-17.
Office Communication for U.S. Appl. No. 16/136,119 dated Nov. 23, 2018, pp. 1-16.
U.S. Appl. No. 14/510,947, filed Oct. 9, 2014.
Office Communication for U.S. Appl. No. 15/925,612 dated Jun. 15, 2018.
Office Communication for U.S. Appl. No. 15/870,758 dated Oct. 1, 2018.
Office Communication for U.S. Appl. No. 16/049,630 dated Oct. 4, 2018.
Office Communication for U.S. Appl. No. 16/136,119 dated Nov. 23, 2018.
International Search Report and Written Opinion for International Patent Application No. PCT/US2019/022942 dated Jul. 4, 2019.
Office Communication for U.S. Appl. No. 16/049,630 dated Jun. 24, 2019.
Office Communication for U.S. Appl. No. 16/280,939 dated Jul. 18, 2019.
Office Communication for U.S. Appl. No. 16/136,119 dated Mar. 15, 2019.
Office Communication for U.S. Appl. No. 16/049,630 dated Apr. 12, 2019.
Office Communication for U.S. Appl. No. 16/280,939 dated May 13, 2019.
Office Communication for U.S. Appl. No. 16/440,815 dated Jul. 17, 2019.
Office Communication for U.S. Appl. No. 16/358,112 dated May 15, 2019.
International Search Report and Written Opinion for International Patent Application No. PCT/US19/022987 dated Jul. 2, 2019.
Office Communication for U.S. Appl. No. 16/292,022 dated Jun. 7, 2019.
International Search Report and Written Opinion for International Patent Application No. PCT/US2019/022942 dated Jul. 4, 2019, pp. 1-12.
Yurduseven et al., "Dual-Polarization Printed Holographic Multibeam Metasurface Antenna" Aug. 7, 2017, IEEE Antennas and Wireless Propagation Letters. pp. 10.1109/LAWP.2017, p. 1-4.
Office Communication for U.S. Appl. No. 16/049,630 dated Jun. 24, 2019, pp. 1-7.
Office Communication for U.S. Appl. No. 16/280,939 dated Jul. 18, 2019, pp. 1-21.
Office Communication for U.S. Appl. No. 16/136,119 dated Mar. 15, 2019, pp. 1-23.
Office Communication for U.S. Appl. No. 16/049,630 dated Apr. 12, 2019, pp. 1-41.
Office Communication for U.S. Appl. No. 16/280,939 dated May 13, 2019, pp. 1-35.
Office Communication for U.S. Appl. No. 16/440,815 dated Jul. 17, 2019, pp. 1-24.
Office Communication for U.S. Appl. No. 16/358,112 dated May 15, 2019, pp. 1-29.
International Search Report and Written Opinion for International Patent Application No. PCT/US19/022987 dated Jul. 2, 2019, pp. 1-13.
Office Communication for U.S. Appl. No. 16/292,022 dated Jun. 7, 2019, pp. 1-43.

* cited by examiner

THERMAL COMPENSATION FOR A HOLOGRAPHIC BEAM FORMING ANTENNA

TECHNICAL FIELD

The present invention relates generally to thermal compensation for extreme operating temperatures of electronic components that are coupled to one or more instances of holographic metasurface antennas (HMAs). The present invention is also directed to providing the thermal compensation by modifying the operation of the electronics corresponding to HMAs when the operating temperature is detected outside a predetermined range of temperatures.

BACKGROUND

A holographic metasurface antenna (HMA) is controlled and operated by electronics that include thousands of individual elements. The correct behavior of the elements is typically verified for a range of temperatures for different object waveforms during the manufacturing process. However, once the HMA is physically installed and operated in a real-world environment, operation/behavior of the electronics and/or scattering elements can change when operating temperatures higher than the verified range are caused by environmental and/or operational factors. In the past, the supply voltage for all of the electronics has been increased to compensate for the high operating temperature and restore "normal" operation of the HMA. Unfortunately, over time, this type of compensation can cause a further increase in an already high operating temperature of the electronics and further degrade their ability to operate normally.

Alternatively, in the past, external cooling components have been attached to HMAs, such as heat sinks, fans, and coolant radiators. However, the extra cost, size, weight, and maintenance for such external cooling components has limited their adoption.

Thus, the various difficulties in thermally compensating for operating temperatures higher than a verified range of temperatures characterized for an HMA has created an opportunity for a solution that can be managed in software locally, or remotely, and does not employ costly additional cooling components to provide robust thermal compensation for HMAs in real world environments.

DETAILED DESCRIPTION OF THE INVENTION

Figure 1A:
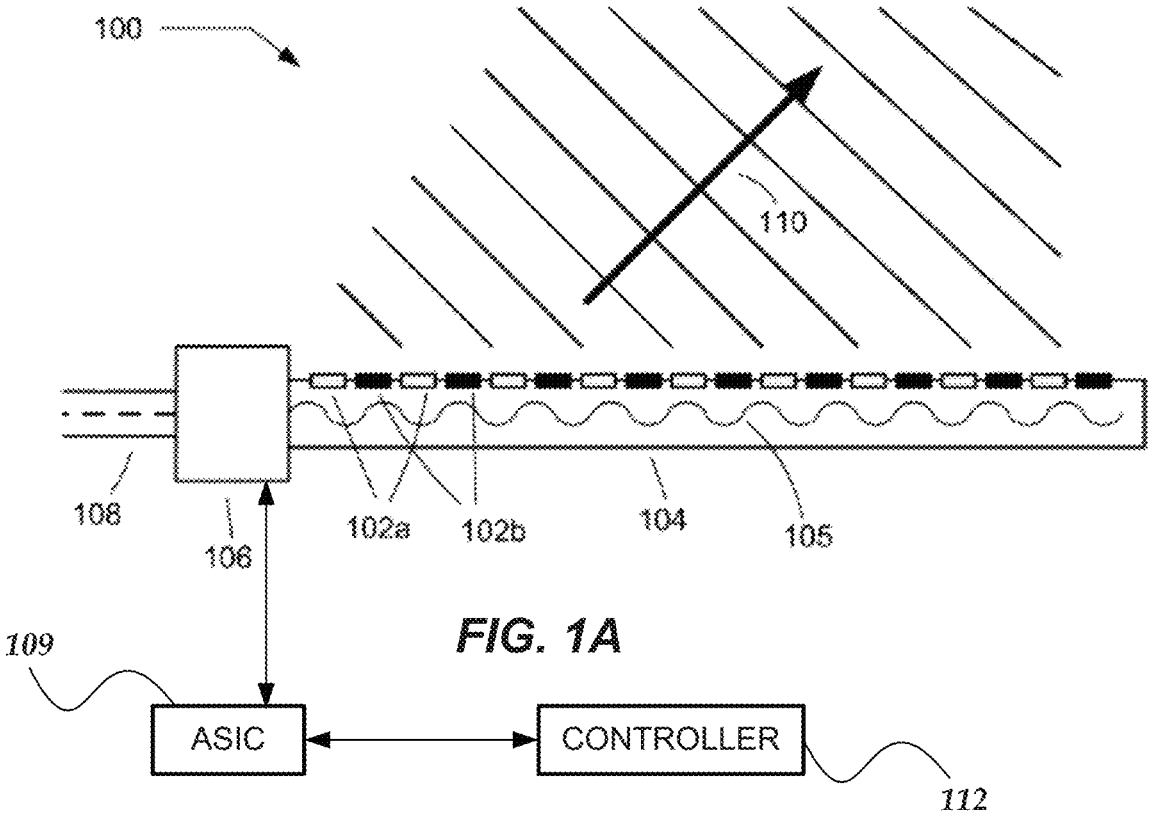
FIG. 1A shown an embodiment of an exemplary surface scattering antenna with multiple varactor elements arranged to propagate electromagnetic waves in such a way as to form an exemplary instance of holographic metasurface antennas (HMA)

The present invention now will be described more fully hereinafter with reference to the accompanying drawings, which form a part hereof, and which show, by way of illustration, specific embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment, an entirely software embodiment or an embodiment combining software and hardware aspects. The following detailed description is, therefore, not to be taken in a limiting sense.

Throughout the specification and claims, the following terms take the meanings explicitly associated herein, unless the context clearly dictates otherwise. The phrase "in one embodiment" as used herein does not necessarily refer to the same embodiment, though it may. Similarly, the phrase "in another embodiment" as used herein does not necessarily refer to a different embodiment, though it may. As used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

The following briefly describes the embodiments of the invention in order to provide a basic understanding of some aspects of the invention. This brief description is not intended as an extensive overview. It is not intended to identify key or critical elements, or to delineate or otherwise narrow the scope. Its purpose is merely to present some concepts in a simplified form as a prelude to the more detailed description that is presented later.

Briefly stated, various embodiments are directed towards compensating for abnormal operating temperatures and/or abnormal behaviors of a holographic metasurface antenna (HMA) that is generating a beam based on a holographic function. In one or more embodiments, the HMA is characterized with different holographic functions for a plurality of operating temperatures and a plurality of behaviors during the manufacturing process. In one or more embodiments, the characterization of the HMA may be employed to identify different hologram functions that cause the HMA to generate more or less heat or exhibit more or less abnormal behavior while generating equivalent beams. Also, in one or more embodiments, one or more characterizations of a hologram function may be performed remotely after the HMA is installed in a real world environment.

Further, in one or more embodiments an operating temperature and/or a temperature gradient of the HMA may be detected by temperature sensors physically located on a circuit board for the HMA. Also, the one or more temperature sensors may include one or more thermistors, temperature transducers, mechanical temperature regulators, or solid state thermostat chips, or the like. And in one or more embodiments, one or more high and/or low thresholds for the operational temperature of the HMA may be determined during manufacturing of the HMA or remotely in a real world environment.

In one or more embodiments, an HMA may use an arrangement of controllable elements to produce an object wave. Also, in one or more embodiments, the controllable elements may employ individual electronic circuits, such as varactors, that have two or more different states. In this way, an object wave can be modified by changing the states of the electronic circuits for one or more of the controllable elements. A control function, such as a hologram function, can be employed to define a current state of the individual controllable elements for a particular object wave. In one or more embodiments, the hologram function can be predetermined or dynamically created in real time in response to various inputs and/or conditions. In one or more embodiments, a library of predetermined hologram functions may be provided. In the one or more embodiments, any type of HMA can be used to that is capable of producing the beams described herein.

FIG. 1A illustrates one embodiment of a HMA which takes the form of a surface scattering antenna 100 (i.e., a HMA) that includes multiple scattering elements 102*a*, 102*b* that are distributed along a wave-propagating structure 104 or other arrangement through which a reference wave 105 can be delivered to the scattering elements. The wave propagating structure 104 may be, for example, a microstrip, a coplanar waveguide, a parallel plate waveguide, a dielectric rod or slab, a closed or tubular waveguide, a substrate-integrated waveguide, or any other structure capable of supporting the propagation of a reference wave 105 along or within the structure. A reference wave 105 is input to the wave-propagating structure 104. The scattering elements 102*a*, 102*b* may include scattering elements that are embedded within, positioned on a surface of, or positioned within an evanescent proximity of, the wave-propagation structure 104. Examples of such scattering elements include, but are not limited to, those disclosed in U.S. Pat. Nos. 9,385,435; 9,450,310; 9,711,852; 9,806,414; 9,806,415; 9,806,416; and 9,812,779 and U.S. Patent Applications Publication Nos. 2017/0127295; 2017/0155193; and 2017/0187123, all of which are incorporated herein by reference in their entirety. Also, any other suitable types or arrangement of scattering elements can be used.

The surface scattering antenna may also include at least one feed connector 106 that is configured to couple the wave-propagation structure 104 to a feed structure 108 which is coupled to a reference wave source (not shown). The feed structure 108 may be a transmission line, a waveguide, or any other structure capable of providing an electromagnetic signal that may be launched, via the feed connector 106, into the wave-propagating structure 104. The feed connector 106 may be, for example, a coaxial-to-microstrip connector (e.g. an SMA-to-PCB adapter), a coaxial-to-waveguide connector, a mode-matched transition section, etc.

The scattering elements 102*a*, 102*b* are adjustable scattering elements having electromagnetic properties that are adjustable in response to one or more external inputs. Adjustable scattering elements can include elements that are adjustable in response to voltage inputs (e.g. bias voltages for active elements (such as varactors, transistors, diodes) or for elements that incorporate tunable dielectric materials (such as ferroelectrics or liquid crystals)), current inputs (e.g. direct injection of charge carriers into active elements), optical inputs (e.g. illumination of a photoactive material), field inputs (e.g. magnetic fields for elements that include nonlinear magnetic materials), mechanical inputs (e.g. MEMS, actuators, hydraulics), or the like. In the schematic example of FIG. 1A, scattering elements that have been adjusted to a first state having first electromagnetic properties are depicted as the first elements 102*a*, while scattering elements that have been adjusted to a second state having second electromagnetic properties are depicted as the second elements 102*b*. The depiction of scattering elements having first and second states corresponding to first and second electromagnetic properties is not intended to be limiting: embodiments may provide scattering elements that are discretely adjustable to select from a discrete plurality of states corresponding to a discrete plurality of different electromagnetic properties, or continuously adjustable to select from a continuum of states corresponding to a continuum of different electromagnetic properties.

In the example of FIG. 1A, the scattering elements 102*a*, 102*b* have first and second couplings to the reference wave 105 that are functions of the first and second electromagnetic properties, respectively. For example, the first and second couplings may be first and second polarizabilities of the scattering elements at the frequency or frequency band of the reference wave. On account of the first and second couplings, the first and second scattering elements 102*a*, 102*b* are responsive to the reference wave 105 to produce a plurality of scattered electromagnetic waves having amplitudes that are functions of (e.g. are proportional to) the respective first and second couplings. A superposition of the scattered electromagnetic waves comprises an electromagnetic wave that is depicted, in this example, as an object wave 110 that radiates from the surface scattering antenna 100.

FIG. 1A illustrates a one-dimensional array of scattering elements 102*a*, 102*b*. It will be understood that two- or three-dimensional arrays can also be used. In addition, these arrays can have different shapes. Moreover, the array illustrated in FIG. 1A is a regular array of scattering elements 102*a*, 102*b* with equidistant spacing between adjacent scattering elements, but it will be understood that other arrays may be irregular or may have different or variable spacing between adjacent scattering elements. Also, Application Specific Integrated Circuit (ASIC) 109 is employed to control the operation of the row of scattering elements 102*a* and 102*b*. Further, controller 112 may be employed to control the operation of one or more ASICs that control one or more rows in the array.

Figure 1B:
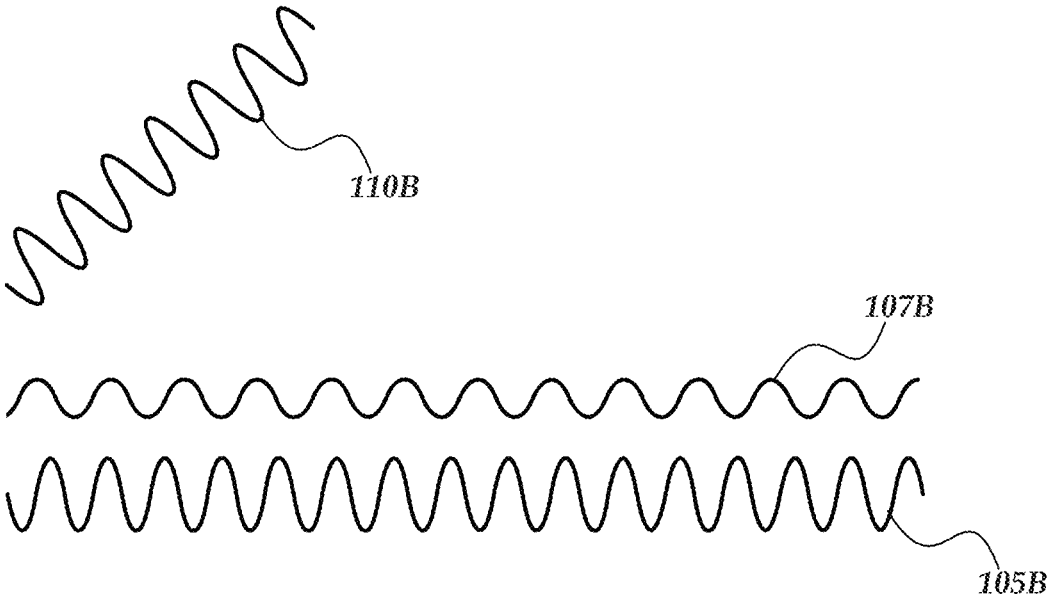
FIG. 1B shows a representation of one embodiment of a synthetic array illustrating a reference waveform and a hologram waveform (modulation function) that in combination provide an object waveform of electromagnetic waves.

The array of scattering elements 102*a*, 102*b* can be used to produce a far-field beam pattern that at least approximates a desired beam pattern by applying a modulation pattern 107B (e.g., a hologram function, H) to the scattering elements receiving the reference wave ($\psi_{ref}$) 105B from a reference wave source, as illustrated in FIG. 1B. Although the modulation pattern or hologram function 107B in FIG. 1B is illustrated as sinusoidal, it will be recognized non-sinusoidal functions (including non-repeating or irregular functions) may also be used. FIG. 1E illustrates one example of a modulation pattern and FIG. 1F illustrates one example of a beam generated using that modulation pattern.

As shown in FIG. 1A, in one or more embodiments, a computing system can calculate, select (for example, from a look-up table, catalog, or database of modulation patterns) or otherwise determine the modulation pattern to apply to the scattering elements 102*a*, 102*b* receiving the RF energy that will result in an approximation of desired beam pattern. In at least some embodiments, a field description of a desired far-field beam pattern is provided and, using a transfer function of free space or any other suitable function, an object wave ($\psi_{obj}$) 110 at an antenna's aperture plane can be determined that results in the desired far-field beam pattern being radiated. The modulation function (e.g., hologram function) can be determined which will scatter reference wave 105 into the object wave 110. The modulation function (e.g., hologram function) is applied to scattering elements 102*a*, 102*b*, which are excited by the reference wave 105, to form an approximation of an object wave 110 which in turn radiates from the aperture plane to at least approximately produce the desired far-field beam pattern.

In at least some embodiments, the hologram function H (i.e., the modulation function) is equal the complex conjugate of the reference wave and the object wave, i.e., $\psi_{ref}^{*}\psi_{obj}$. Examples of such arrays, antennas, and the like can be found at U.S. Pat. Nos. 9,385,435; 9,450,310; 9,711,852; 9,806,414; 9,806,415; 9,806,416; and 9,812,779 and U.S. Patent Applications Publication Nos. 2017/0127295; 2017/0155193; and 2017/0187123, all of which are incorporated herein by reference in their entirety. In at least some embodiments, the surface scattering antenna may be adjusted to provide, for example, a selected beam direction (e.g. beam steering), a selected beam width or shape (e.g. a fan or pencil beam having a broad or narrow beam width), a selected arrangement of nulls (e.g. null steering), a selected arrangement of multiple beams, a selected polarization state (e.g. linear, circular, or elliptical polarization), a selected overall phase, or any combination thereof. Alternatively, or additionally, embodiments of the surface scattering antenna may be adjusted to provide a selected near field radiation profile, e.g. to provide near-field focusing or near-field nulls.

The surface scattering antenna can be considered a holographic beamformer which, at least in some embodiments, is dynamically adjustable to produce a far-field radiation pattern or beam. In some embodiments, the surface scattering antenna includes a substantially one-dimensional wave-propagating structure 104 having a substantially one-dimensional arrangement of scattering elements. In other embodiments, the surface scattering antenna includes a substantially two-dimensional wave-propagating structure 104 having a substantially two-dimensional arrangement of scattering elements. In at least some embodiments, the array of scattering elements 102*a*, 102*b* can be used to generate a narrow, directional far-field beam pattern, as illustrated, for example, in FIG. 1C. It will be understood that beams with other shapes can also be generated using the array of scattering elements 102*a*, 102*b*.

In at least some of the embodiments, the narrow far-field beam pattern can be generated using a holographic metasurface antenna (HMA) and may have a width that is 5 to 20 degrees in extent. The width of the beam pattern can be determined as the broadest extent of the beam or can be defined at a particular region of the beam, such as the width at 3 dB attenuation. Any other suitable method or definition for determining width can be used.

A wider beam pattern (also referred to as a "radiation pattern") is desirable in a number of applications, but the achievable width may be limited by, or otherwise not available using, a single HMA. Multiple instances of HMAs can be positioned in an array of HMAs to produce a wider composite far-field beam pattern. It will be recognized, however, that the individual beam patterns from the individual HMAs will often interact and change the composite far-field beam pattern so that, at least in some instances, without employing the one or more embodiments of the invention, the simple combination of the outputs of multiple instances of HMAs produces a composite far-field beam pattern that does not achieve the desired or intended configuration.

Additionally, although not shown in FIG. 1A, the invention is not limited to a radio device as the RF source to emit the RF signal. Rather, in other embodiments, many different types of RF sources may be employed to emit the RF signal. For example, RF oscillators, Scalar Signal generators, Vector Network Analyzers (VNAs), or the like may also be employed to emit the RF signal in various embodiments.

Also, although not shown, the invention is not limited to a varactor as a control element that enables a scattering element to emit an RF signal. Rather, many different types of control elements may be employed in this way. For example, one or more other embodiments may instead employ Field Effect Transistors (FETs), Microelectromechanical Systems (MEMS), Bipolar Junction Transistors (BSTs), or the like to enable scattering elements to turn on and turn off emitting the RF signal.

Figure 1C:
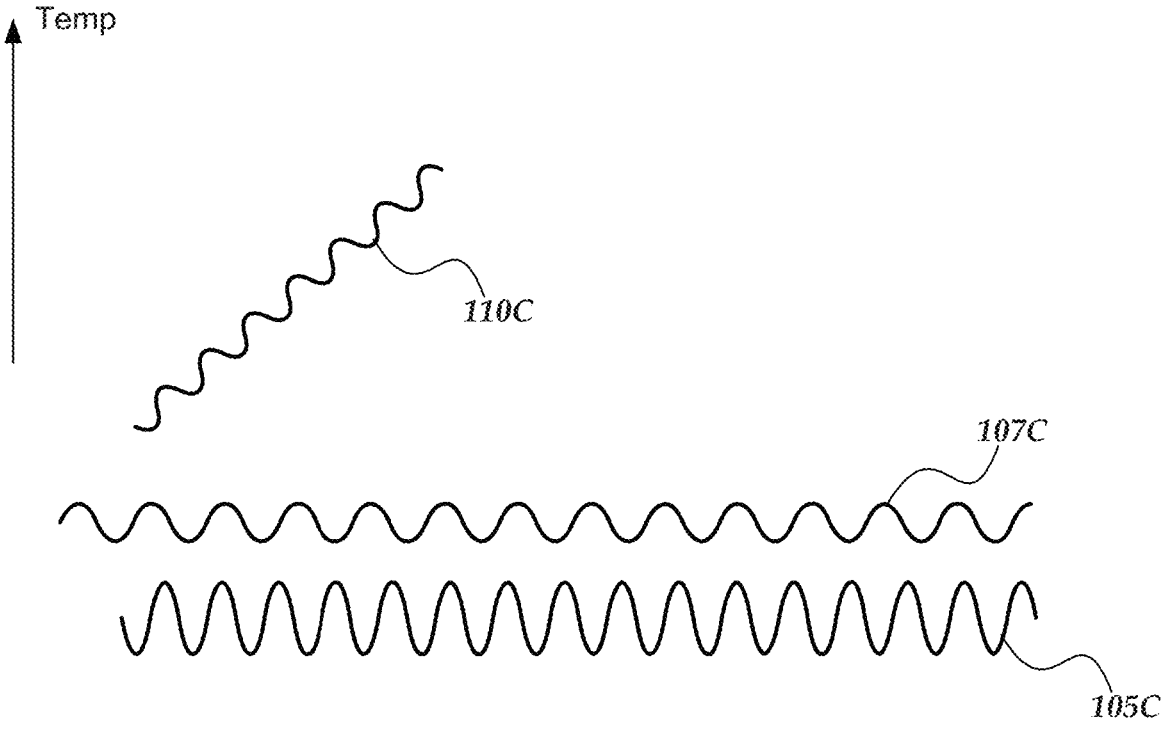
FIG. 1C shows a representation of one embodiment of a synthetic array illustrating a reference waveform and a hologram waveform (modulation function) that in combination provide an object waveform of electromagnetic waves having diminished amplitude at a higher operating temperature.

Additionally, FIG. 1C illustrates how an operating temperature can be high enough to cause a change in object wave 110C that generates the far-field beam pattern. In this example, a higher operating temperature of the HMA has caused one or more physical attributes or behaviors of the scattering elements to change enough to diminish an amplitude of object wave 110C. It is noteworthy that even though reference wave 105C and hologram function 107C were not changed by the high operating temperature, the amplitude of the object wave affected by the high temperature induced change in the physical attributes/behaviors of the scattering elements.

Figure 1D:
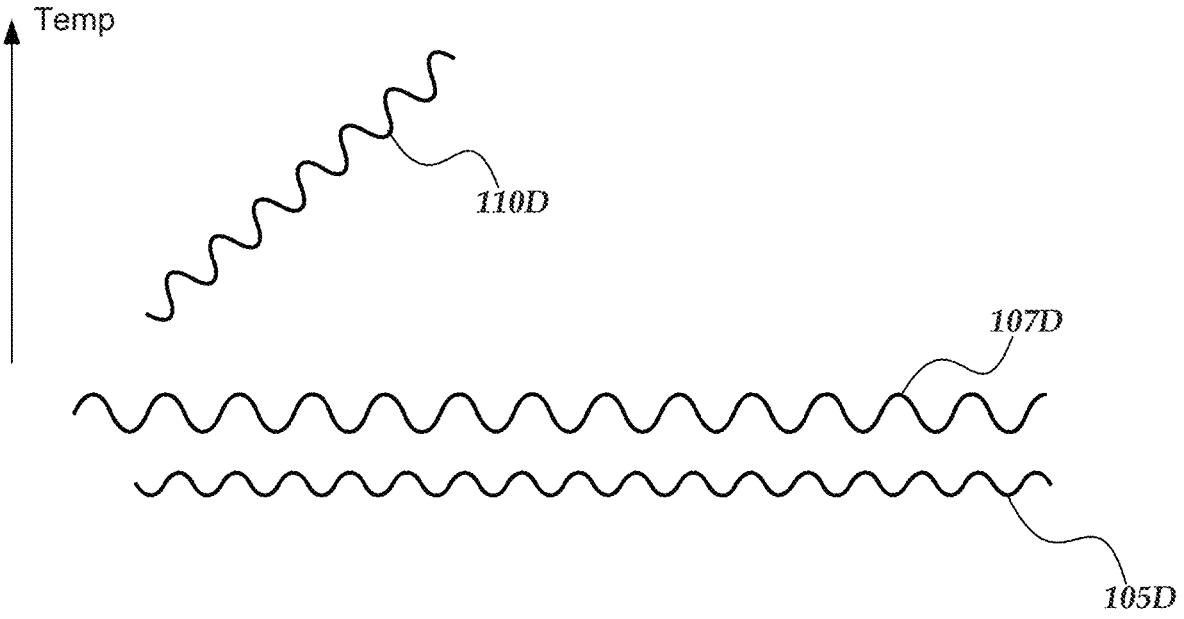
FIG. 1D shows a representation of one embodiment of a synthetic array illustrating a reference waveform and a hologram waveform (modulation function) that in combination provide an object waveform of electromagnetic waves having diminished amplitude at a higher operating temperature.
Figure 1E:
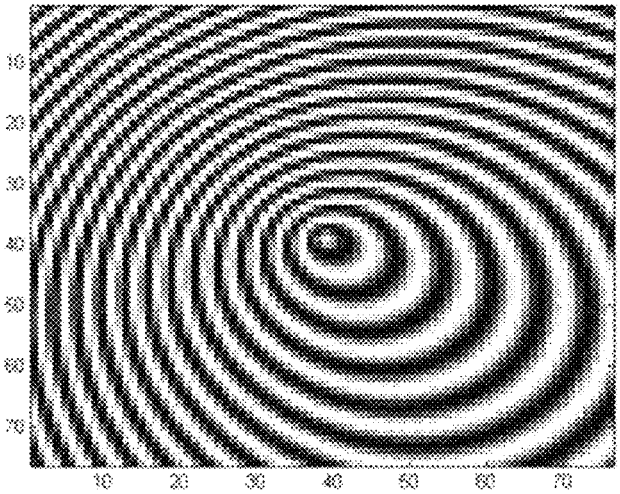
FIG. 1E shows an embodiment of an exemplary modulation function for an exemplary surface scattering antenna.
Figure 1F:
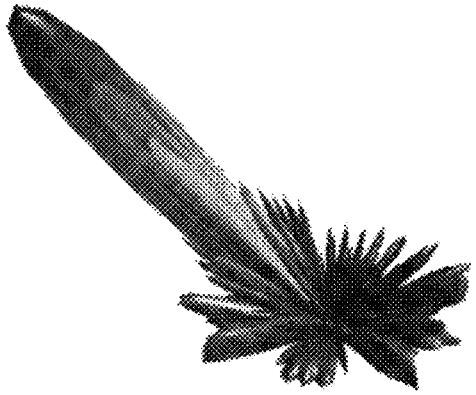
FIG. 1F shows an embodiment of an exemplary beam of electromagnetic waves generated by the modulation function of FIG. 1C.

Also, FIG. 1D illustrates how an operating temperature can be high enough to cause a change in object wave 110D that generates the far-field beam pattern. In this example, a higher operating temperature of the HMA has caused the HMA electronics that generate reference wave 105D to change their behavior enough to diminish an amplitude of reference wave 105D that is provided to hologram function 107D. It is noteworthy that the diminished amplitude of reference wave 105D results in unchanged hologram function 107D, which controls the operation of the scattering elements, to generate a diminished amplitude of object wave 110D.

Although FIGS. 1C and 1D illustrate changes in the amplitude of the generated object wave caused by higher operating temperatures of the HMA, it is understood that the temperature induced changes in the object wave may result in more changes than just amplitude, e.g., one or more of a phase shift, a non-sinusoidal waveform, or the like.

Figure 2A:
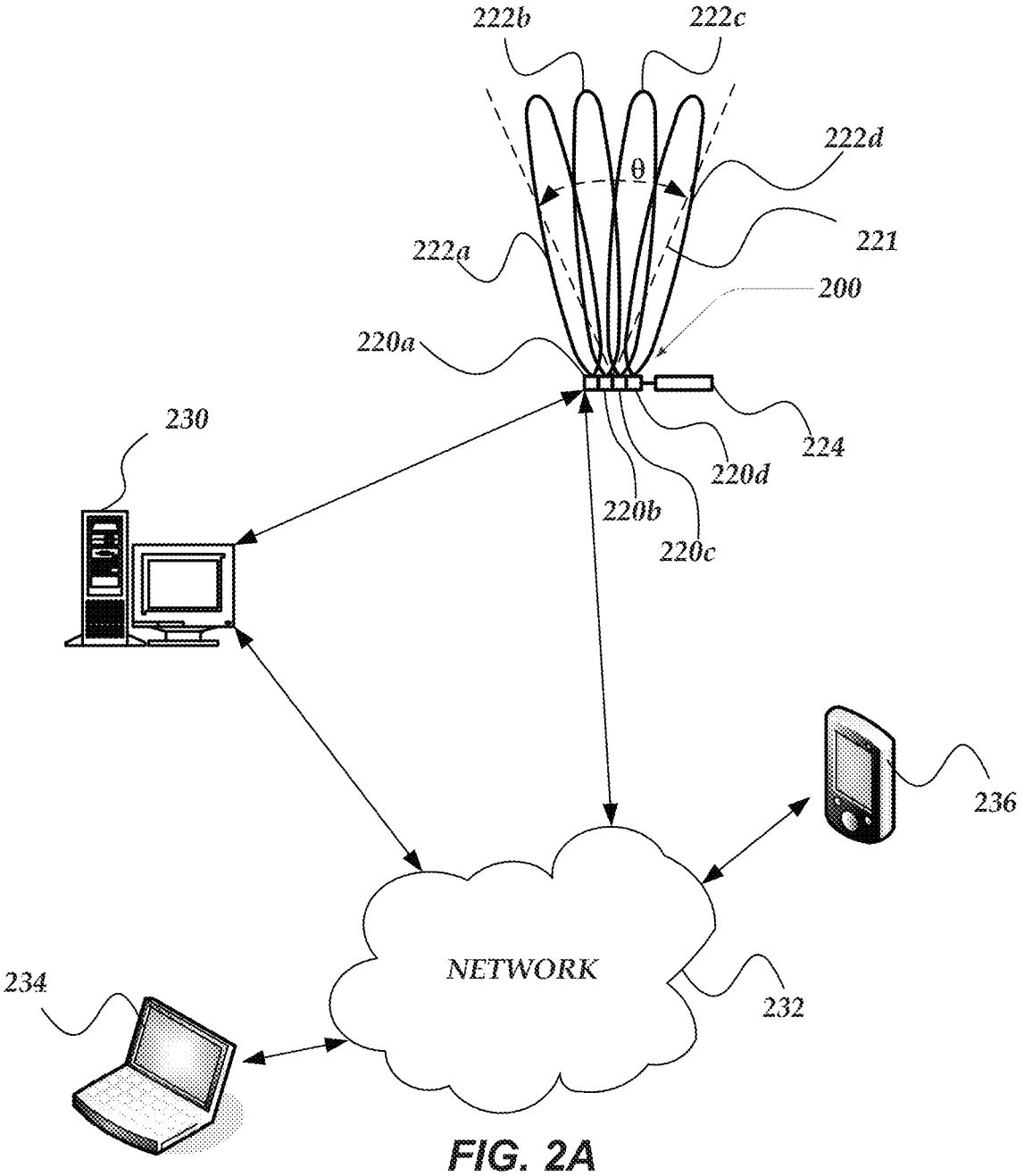
FIG. 2A shows a side view an embodiment of an exemplary environment, including an arrangement of multiple instances of HMAs propagating beams, in which various embodiments of the invention may be implemented.

FIG. 2A illustrates one embodiment of a beam-forming system 200 with an arrangement of multiple instances of HMAs (e.g., surface scattering antennas or holographic beamformers) 220*a*, 220*b*, 220*c*, 220*d* that each produce a beam 222*a*, 222*b*, 222*c*, 222*d* (i.e., a far-field radiation pattern) and are coupled to a reference wave source 224 (or multiple reference wave sources). In the illustrated example, the beams 222*a*, 222*b*, 222*c*, 222*d* are arranged to produce a coverage area 221 which, at least in some embodiments, can be described by angle θ (for example, the coverage angle at 3 Db). It will be understood that other methods of describing the desired coverage area can also be used.

The HMAs 220*a*, 220*b*, 220*c*, 220*d* may be identical in arrangement or composition of the array of scattering elements or may different in arrangement or composition of the array of scattering elements. In some embodiments, different reference waves may be provided to some or all of the HMAs. In at least some embodiments, the position or orientation of one or more of the HMAs may be adjustable relative to the other HMAs. In FIG. 2A, the illustrated arrangement of HMAs is one-dimensional and regular. It will be understood, however, that two- or three-dimensional arrangements of HMAs can also be used. In addition, these arrangements can have different shapes. Moreover, the arrangement illustrated in FIG. 2A is a regular arrangement of HMAs 220*a*, 220*b*, 220*c*, 220*d* with equidistant spacing between adjacent HMAs, but it will be understood that other arrangements may be irregular or may have different or variable spacing between adjacent HMAs.

Figure 2B:
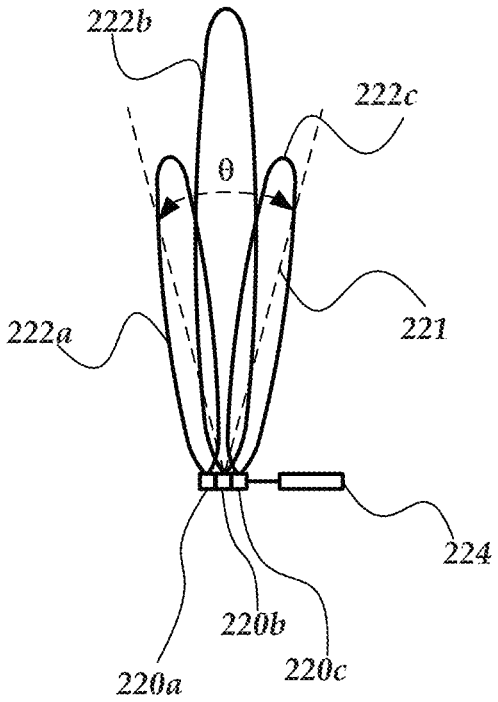
FIG. 2B shows a side view of another embodiment of an exemplary arrangement of multiple instances of HMAs.
Figure 2C:
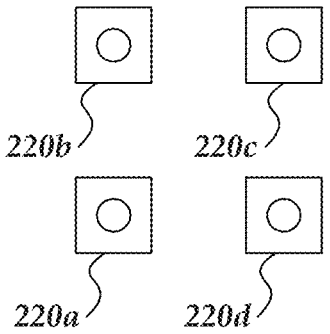
FIG. 2C shows a top view of yet another embodiment of an exemplary arrangement of multiple instances of HMAs.

As an example, FIG. 2B illustrates another arrangement of HMAs 220*a*, 220*b*, 220*c* that produce beams 222*a*, 222*b*, 222*c* where the middle beam 222*b* is substantially different in size and shape from the other two beams 222*a*, 222*c*. FIG. 2C illustrates, in a top view, yet another arrangement of HMAs 220*a*, 220*b*, 220*c*, 220*d* which form a two-dimensional array.

In at least some embodiments, the system 200 includes, or is coupled to, a computer device 230 or other control device that can control one or more of the HMAs 220*a*, 220*b*, 220*c* 220*d*, the reference wave source 224, or any other components of the system, or any combination thereof. For example, the computer device 230 may be capable of dynamically changing the HMAs (e.g., dynamically alter the hologram function) to modify the beam generated using the HMA. Alternatively or additionally, the system 200 may include, or be coupled to, a network 232 which is in turn coupled to a computer device, such as computer device 234 or mobile device 236. The computer device 234 or mobile device 232 can control one or more of the HMAs 220*a*, 220*b*, 220*c* 220*d*, the reference wave source 224, or any other components of the system.

Various embodiments of a computer device 230, 234 (which may also be a mobile device 232) are described in more detail below in conjunction with FIG. 3. Briefly, however, computer device 230, 234 includes virtually various computer devices enabled to control the arrangement 200. Based on the desired beam pattern, the computer device 230, 234 may alter or otherwise modify one or more of the HMAs 220*a*, 220*b*, 220*c*, 220*d*.

Network 232 may be configured to couple network computers with other computing devices, including computer device 230, computer device 234, mobile device 236, HMAs 220*a*, 220*b*, 220*c*, 220*d*, or reference wave source 224 or any combination thereof. Network 232 may include various wired and/or wireless technologies for communicating with a remote device, such as, but not limited to, USB cable, Bluetooth®, Wi-Fi®, or the like. In some embodiments, network 232 may be a network configured to couple network computers with other computing devices. In various embodiments, information communicated between devices may include various kinds of information, including, but not limited to, processor-readable instructions, remote requests, server responses, program modules, applications, raw data, control data, system information (e.g., log files), video data, voice data, image data, text data, structured/unstructured data, or the like. In some embodiments, this information may be communicated between devices using one or more technologies and/or network protocols.

In some embodiments, such a network may include various wired networks, wireless networks, or various combinations thereof. In various embodiments, network 232 may be enabled to employ various forms of communication technology, topology, computer-readable media, or the like, for communicating information from one electronic device to another. For example, network 232 can include—in addition to the Internet—LANs, WANs, Personal Area Networks (PANs), Campus Area Networks, Metropolitan Area Networks (MANs), direct communication connections (such as through a universal serial bus (USB) port), or the like, or various combinations thereof.

In various embodiments, communication links within and/or between networks may include, but are not limited to, twisted wire pair, optical fibers, open air lasers, coaxial cable, plain old telephone service (POTS), wave guides, acoustics, full or fractional dedicated digital lines (such as T1, T2, T3, or T4), E-carriers, Integrated Services Digital Networks (ISDNs), Digital Subscriber Lines (DSLs), wireless links (including satellite links), or other links and/or carrier mechanisms known to those skilled in the art. Moreover, communication links may further employ various ones of a variety of digital signaling technologies, including without limit, for example, DS-0, DS-1, DS-2, DS-3, DS-4, OC-3, OC-12, OC-48, or the like. In some embodiments, a router (or other intermediate network device) may act as a link between various networks—including those based on different architectures and/or protocols—to enable information to be transferred from one network to another. In other embodiments, remote computers and/or other related electronic devices could be connected to a network via a modem and temporary telephone link. In essence, network 232 may include various communication technologies by which information may travel between computing devices.

Network 232 may, in some embodiments, include various wireless networks, which may be configured to couple various portable network devices, remote computers, wired networks, other wireless networks, or the like. Wireless networks may include various ones of a variety of sub-networks that may further overlay stand-alone ad-hoc networks, or the like, to provide an infrastructure-oriented connection for at least client computer. Such sub-networks may include mesh networks, Wireless LAN (WLAN) networks, cellular networks, or the like. In one or more of the various embodiments, the system may include more than one wireless network.

Network 232 may employ a plurality of wired and/or wireless communication protocols and/or technologies. Examples of various generations (e.g., third (3G), fourth (4G), or fifth (5G)) of communication protocols and/or technologies that may be employed by the network may include, but are not limited to, Global System for Mobile communication (GSM), General Packet Radio Services (GPRS), Enhanced Data GSM Environment (EDGE), Code Division Multiple Access (CDMA), Wideband Code Division Multiple Access (W-CDMA), Code Division Multiple Access 2000 (CDMA2000), High Speed Downlink Packet Access (HSDPA), Long Term Evolution (LTE), Universal Mobile Telecommunications System (UMTS), Evolution-Data Optimized (Ev-DO), Worldwide Interoperability for Microwave Access (WiMax), time division multiple access (TDMA), Orthogonal frequency-division multiplexing (OFDM), ultra-wide band (UWB), Wireless Application Protocol (WAP), user datagram protocol (UDP), transmission control protocol/Internet protocol (TCP/IP), various portions of the Open Systems Interconnection (OSI) model protocols, session initiated protocol/real-time transport protocol (SIP/RTP), short message service (SMS), multimedia messaging service (MMS), or various ones of a variety of other communication protocols and/or technologies. In essence, the network may include communication technologies by which information may travel between light source 104, photon receiver 106, and tracking computer device 110, as well as other computing devices not illustrated.

In various embodiments, at least a portion of network 232 may be arranged as an autonomous system of nodes, links, paths, terminals, gateways, routers, switches, firewalls, load balancers, forwarders, repeaters, optical-electrical converters, or the like, which may be connected by various communication links. These autonomous systems may be configured to self-organize based on current operating conditions and/or rule-based policies, such that the network topology of the network may be modified.

Figure 2D:
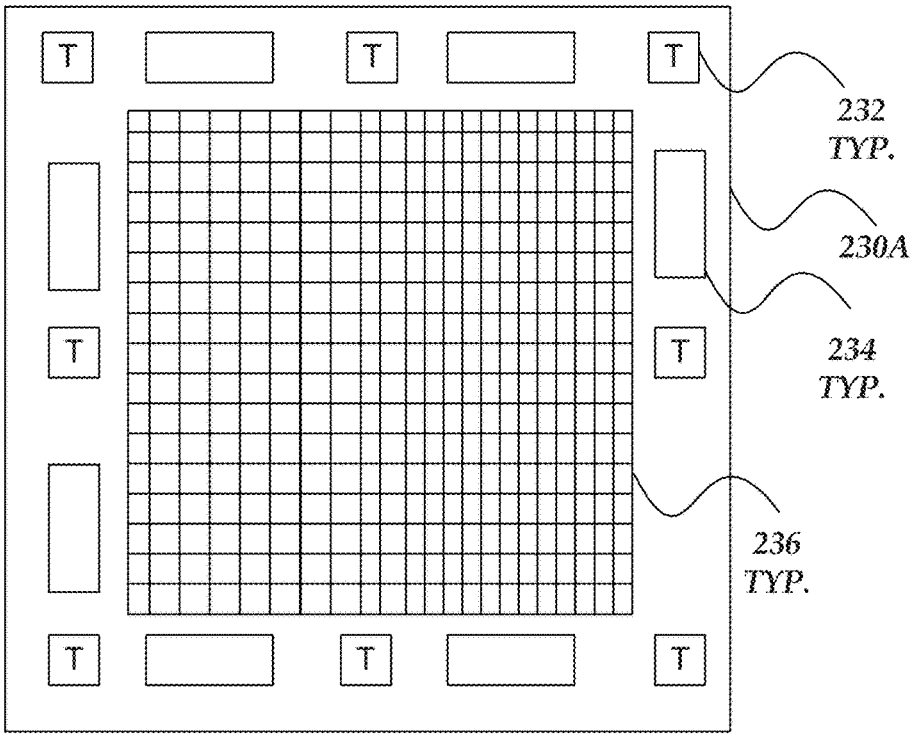
FIG. 2D illustrates a schematic top view of an HMA showing approximate placement of scattering elements, temperature sensors, and other electronic components.

FIG. 2D illustrates a schematic top view of an HMA circuit board 230A showing approximate placement of scattering elements 236, temperature sensors 232, and other electronic components 234 such as driver circuits. Depending on the hologram function provided to configure an object waveform, one or more scattering elements are turned "on", which in the aggregate generate a corresponding beam. Also, one or more of the driver circuits are employed to provide gain for a particular beam. Thus, the operational temperature of the HMA can be reduced if only those driver circuits necessary to provide gain for the particular beam are energized, and the remaining driver circuits are de-energized or idled.

Figure 2E:
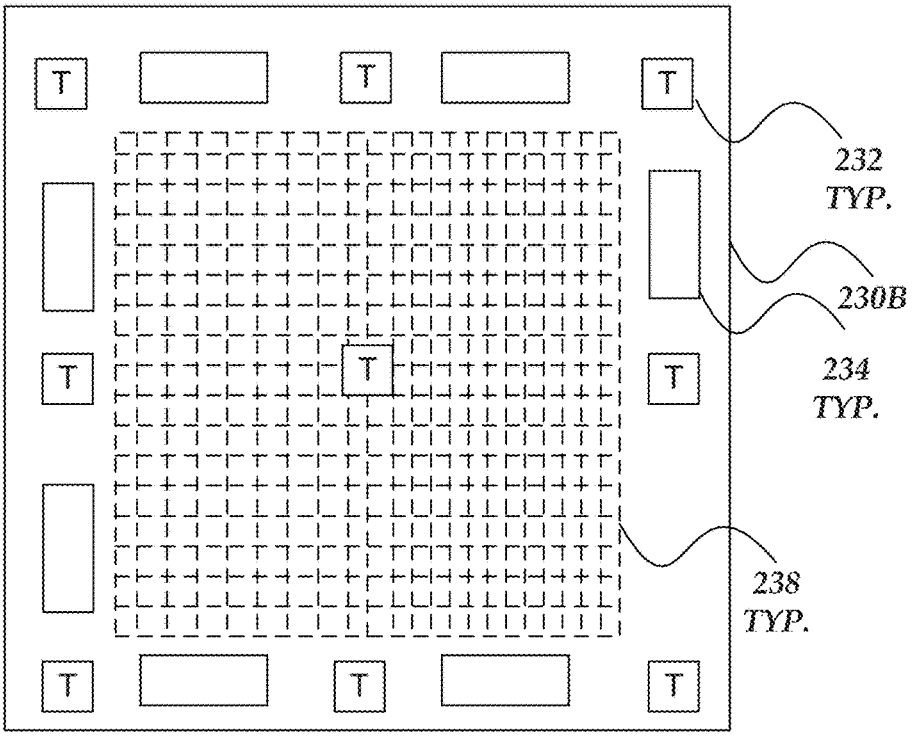
FIG. 2E shows a schematic bottom view of an HMA illustrating approximate placement of tuning elements to control operation of corresponding scattering elements, temperature sensors, and other electronic components.

FIG. 2E shows a schematic bottom view of an HMA circuit board 230B illustrating approximate placement of tuning elements 238 to control operation of corresponding scattering elements 236 (not shown), temperature sensors 232, and other electronic components 234, such as driver circuits. Depending on the hologram function provided to configure an object waveform, one or more tuning scattering elements are energized, which turn "on" corresponding tuning elements on the top side of the circuit board and which in the aggregate generate a corresponding beam. Also, one or more of the driver circuits are employed to provide gain for a particular beam. Thus, the operational temperature of the HMA can be reduced if only those driver circuits necessary to provide gain for the particular beam are energized, and the remaining driver circuits are de-energized or idled.

Figure 2F:
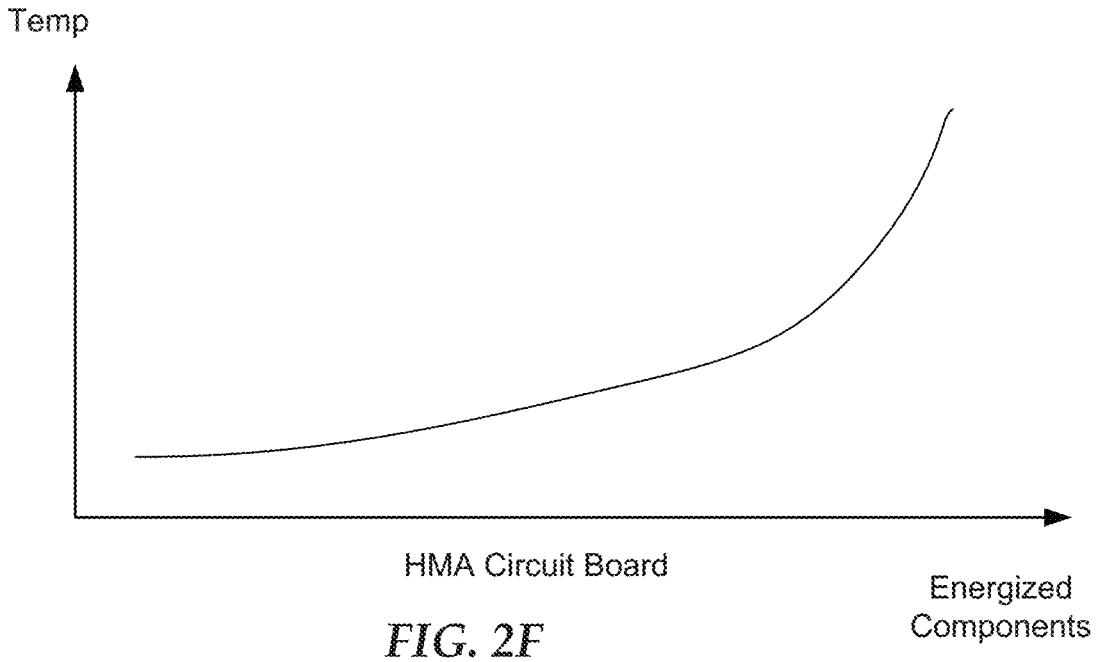
FIG. 2F illustrates an exemplary graph showing the relationship of operational temperature of an HMA versus the number of energized components on a circuit board integrated with the HMA.

FIG. 2F illustrates an exemplary graph showing the relationship of operating temperature of an HMA versus the number of energized components, such as driver circuits, on a circuit board integrated with the HMA. As shown, as the number of components are energized, the operating temperature of the HMA increases.

Figure 2G:
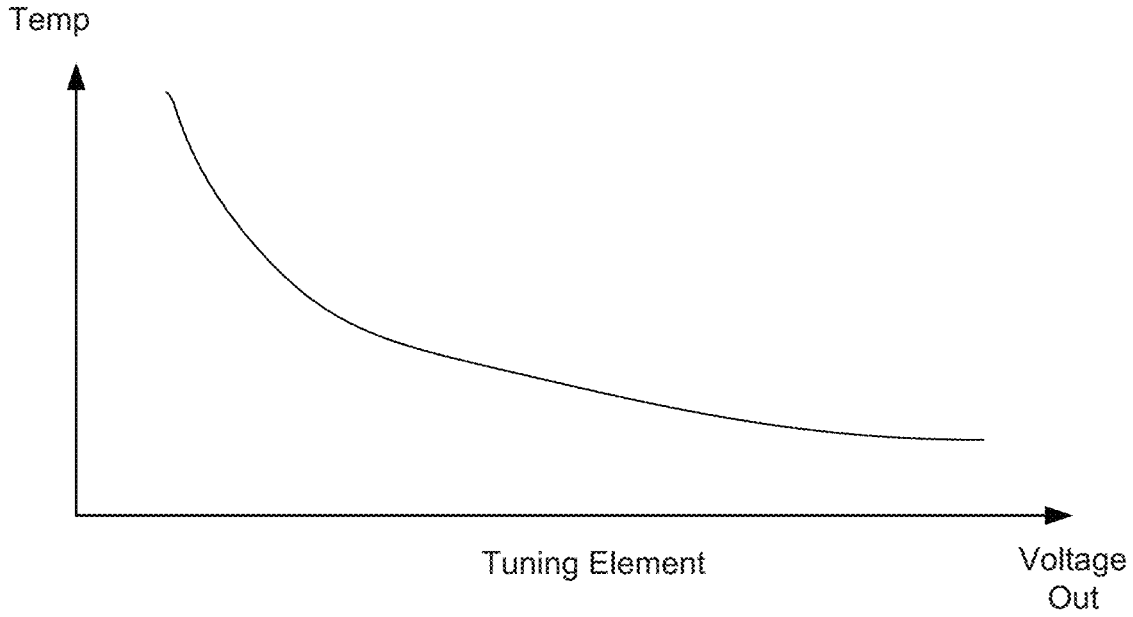
FIG. 2G shows an exemplary graph illustrating the relationship of the operational temperature of an HMA and the voltage out for a tuning element, such as a varactor based circuit, of a scattering element included in the HMA.

FIG. 2G shows an exemplary graph illustrating the relationship of the operating temperature of an HMA and the voltage out for a tuning element, such as a varactor based circuit, of a scattering element included in the HMA. As shown, as the operating temperature of the HMA increases, the detected output voltage of a tuning element decreases.

Additionally, although not shown in the figures, in one or more embodiments, the operational temperature of the HMA can be estimated by monitoring the output voltage behavior of energized tuning elements, instead of relying upon one or more temperature sensors. For example, if the voltage output of an energized tuning element decreases from 6 volts to 4 volts over time, then the behavior of the tuning element may be characterized as abnormal and likely caused by an operational temperature that is greater than a predetermined range of temperatures suitable for normal operation of the HMA. Also, a magnitude of the voltage output decrease can be correlated to a likely operating temperature of the HMA.

Furthermore, in one or more embodiments, detection of abnormal behavior in the output voltage of a tuning circuit can be employed to confirm an out of range temperature detected by one or more temperature sensors. Also, in one or more embodiments, an amount and magnitude of monitored abnormal behavior in voltage output may be employed to adjust coefficients of a hologram function to optimize its compensation for an out of range (too high or too low) operating temperature of the HMA.

Illustrative Network Computer

Figure 3:
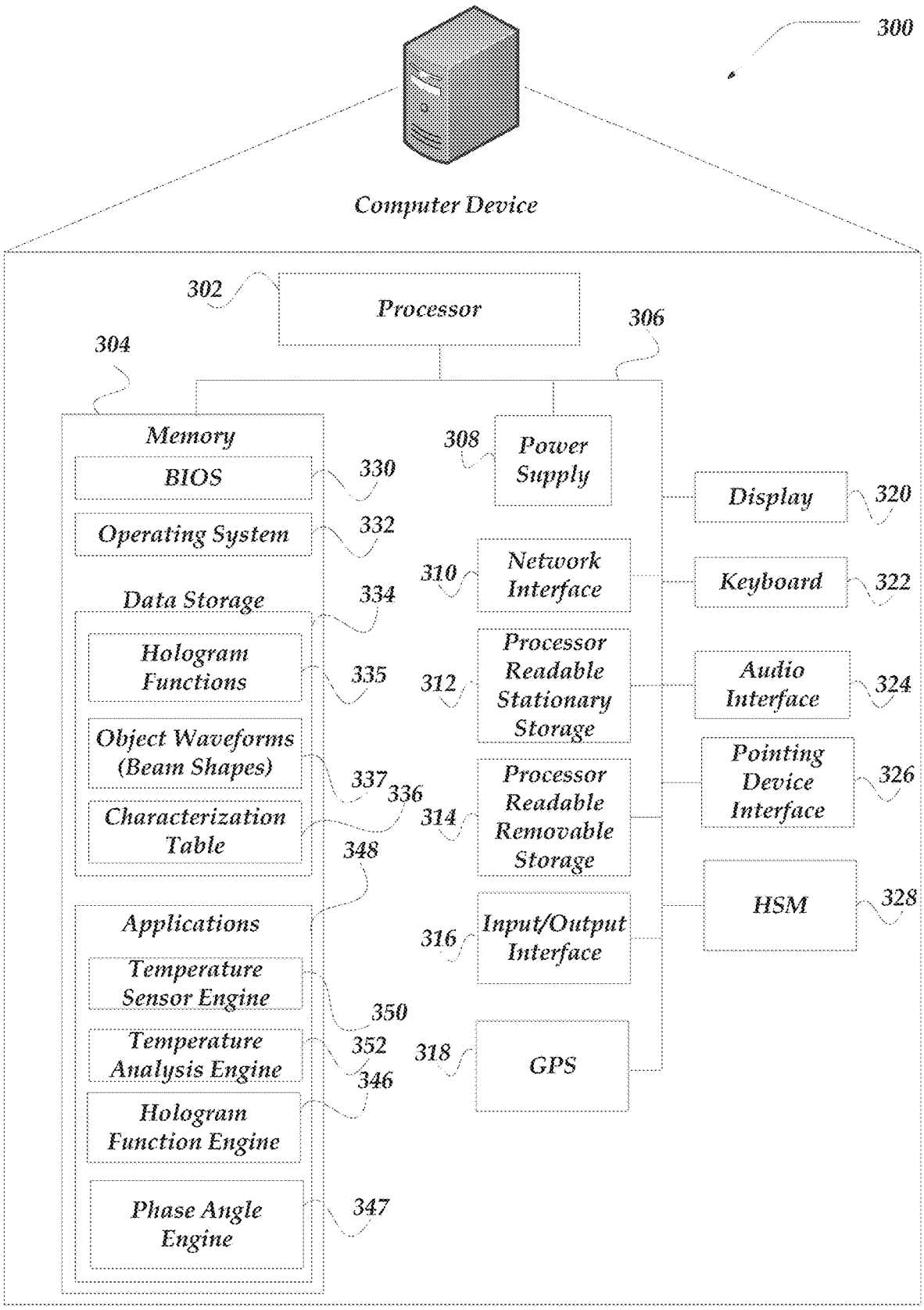
FIG. 3 illustrates an embodiment of an exemplary computer device that may be included in a system such as that shown in FIG. 2A.

FIG. 3 shows one embodiment of an exemplary computer device 300 that may be included in an exemplary system implementing one or more of the various embodiments. Computer device 300 may include many more or less components than those shown in FIG. 3. However, the components shown are sufficient to disclose an illustrative embodiment for practicing these innovations. Computer device 300 may include a desktop computer, a laptop computer, a server computer, a client computer, and the like. Computer device 300 may represent, for example, one embodiment of one or more of a laptop computer, smartphone/tablet, computer device 230, 234 or mobile device 236 of FIG. 2A or may be part of the system 200, such as a part of one or more of the HMAs 220*a*, 220*b*, 220*c*, 220*d*, or reference wave source 224 or the like.

As shown in FIG. 3, computer device 300 includes one or more processors 302 that may be in communication with one or more memories 304 via a bus 306. In some embodiments, one or more processors 302 may be comprised of one or more hardware processors, one or more processor cores, or one or more virtual processors. In some cases, one or more of the one or more processors may be specialized processors or electronic circuits particularly designed to perform one or more specialized actions, such as, those described herein. Computer device 300 also includes a power supply 308, network interface 310, non-transitory processor-readable stationary storage device 312 for storing data and instructions, non-transitory processor-readable removable storage device 314 for storing data and instructions, input/output interface 316, GPS transceiver 318, display 320, keyboard 322, audio interface 324, pointing device interface 326, and HSM 328, although a computer device 300 may include fewer or more components than those illustrated in FIG. 3 and described herein. Power supply 308 provides power to computer device 300.

Network interface 310 includes circuitry for coupling computer device 300 to one or more networks, and is constructed for use with one or more communication protocols and technologies including, but not limited to, protocols and technologies that implement various portions of the Open Systems Interconnection model (OSI model), global system for mobile communication (GSM), code division multiple access (CDMA), time division multiple access (TDMA), user datagram protocol (UDP), transmission control protocol/Internet protocol (TCP/IP), Short Message Service (SMS), Multimedia Messaging Service (MMS), general packet radio service (GPRS), WAP, ultra wide band (UWB), IEEE 802.16 Worldwide Interoperability for Microwave Access (WiMax), Session Initiation Protocol/Real-time Transport Protocol (SIP/RTP), or various ones of a variety of other wired and wireless communication protocols. Network interface 310 is sometimes known as a transceiver, transceiving device, or network interface card (NIC). Computer device 300 may optionally communicate with a base station (not shown), or directly with another computer.

Audio interface 324 is arranged to produce and receive audio signals such as the sound of a human voice. For example, audio interface 324 may be coupled to a speaker and microphone (not shown) to enable telecommunication with others and/or generate an audio acknowledgement for some action. A microphone in audio interface 324 can also be used for input to or control of computer device 300, for example, using voice recognition.

Display 320 may be a liquid crystal display (LCD), gas plasma, electronic ink, light emitting diode (LED), Organic LED (OLED) or various other types of light reflective or light transmissive display that can be used with a computer. Display 320 may be a handheld projector or pico projector capable of projecting an image on a wall or other object.

Computer device 300 may also comprise input/output interface 316 for communicating with external devices or computers not shown in FIG. 3. Input/output interface 316 can utilize one or more wired or wireless communication technologies, such as USB™, Firewire™, Wi-Fi™, WiMax, Thunderbolt™, Infrared, Bluetooth™, Zigbee™, serial port, parallel port, and the like.

Also, input/output interface 316 may also include one or more sensors for determining geolocation information (e.g., GPS), monitoring electrical power conditions (e.g., voltage sensors, current sensors, frequency sensors, and so on), monitoring weather (e.g., thermostats, barometers, anemometers, humidity detectors, precipitation scales, or the like), or the like. Sensors may be one or more hardware sensors that collect and/or measure data that is external to computer device 300. Human interface components can be physically separate from computer device 300, allowing for remote input and/or output to computer device 300. For example, information routed as described here through human interface components such as display 320 or keyboard 322 can instead be routed through the network interface 310 to appropriate human interface components located elsewhere on the network. Human interface components include various components that allow the computer to take input from, or send output to, a human user of a computer. Accordingly, pointing devices such as mice, styluses, track balls, or the like, may communicate through pointing device interface 326 to receive user input.

Memory 304 may include Random Access Memory (RAM), Read-Only Memory (ROM), and/or other types of memory. Memory 304 illustrates an example of computer-readable storage media (devices) for storage of information such as computer-readable instructions, data structures, program modules or other data. Memory 304 stores a basic input/output system (BIOS) 330 for controlling low-level operation of computer device 300. The memory also stores an operating system 332 for controlling the operation of computer device 300. It will be appreciated that this component may include a general-purpose operating system such as a version of UNIX, or LINUX™, or a specialized operating system such as Microsoft Corporation's Windows® operating system, or the Apple Corporation's IOS® operating system. The operating system may include, or interface with a Java virtual machine module that enables control of hardware components and/or operating system operations via Java application programs. Likewise, other runtime environments may be included.

Memory 304 may further include one or more data storage 334, which can be utilized by computer device 300 to store, among other things, applications 336 and/or other data. For example, data storage 334 may also be employed to store information that describes various capabilities of computer device 300. In one or more of the various embodiments, data storage 334 may store hologram function information 335, characterization table 336, or object waveform (beam shape) information 337. The hologram function information 335, one or more characterized temperature ranges, temperature thresholds, normal operation or abnormal behaviors based on temperature for a hologram function or beam shape information 337 may then be employed by temperature analysis engine 352 or provided to another device or computer based on various ones of a variety of methods, including being sent as part of a header during a communication, sent upon request, or the like. Data storage 334 may also be employed to store social networking information including address books, buddy lists, aliases, user profile information, or the like. Data storage 334 may further include program code, data, algorithms, and the like, for use by one or more processors, such as processor 302 to execute and perform actions such as those actions described below. In one embodiment, at least some of data storage 334 might also be stored on another component of computer device 300, including, but not limited to, non-transitory media inside non-transitory processor-readable stationary storage device 312, processor-readable removable storage device 314, or various other computer-readable storage devices within computer device 300, or even external to computer device 300.

Applications 348 may include computer executable instructions which, if executed by computer device 300, transmit, receive, and/or otherwise process messages (e.g., SMS, Multimedia Messaging Service (MMS), Instant Message (IM), email, and/or other messages), audio, video, and enable telecommunication with another user of another mobile computer. Other examples of application programs include calendars, search programs, email client applications, IM applications, SMS applications, Voice Over Internet Protocol (VOIP) applications, contact managers, task managers, transcoders, database programs, word processing programs, security applications, spreadsheet programs, games, search programs, and so forth. Applications 336 may include hologram function engine 346, phase angle engine 347, temperature sensor engine 350, or temperature analysis engine 352, that performs actions further described below. In one or more of the various embodiments, one or more of the applications may be implemented as modules and/or components of another application. Further, in one or more of the various embodiments, applications may be implemented as operating system extensions, modules, plugins, or the like.

Furthermore, in one or more of the various embodiments, specialized applications such as hologram function engine 346, phase angle engine 347, temperature sensor engine 350, and/or temperature analysis engine 352, may be operative in a networked computing environment to perform specialized actions described herein. In one or more of the various embodiments, these applications, and others, may be executing within virtual machines and/or virtual servers that may be managed in a networked environment such as a local network, wide area network, or cloud-based based computing environment. In one or more of the various embodiments, in this context the applications may flow from one physical computer device within the cloud-based environment to another depending on performance and scaling considerations automatically managed by the cloud computing environment. Likewise, in one or more of the various embodiments, virtual machines and/or virtual servers dedicated to the hologram function engine 346, phase angle engine 347, temperature sensor engine 350, and/or temperature behavior engine 352, may be provisioned and decommissioned automatically.

Also, in one or more of the various embodiments, the hologram function engine 346, phase angle engine 347, temperature sensor engine 350, temperature analysis engine 352, or the like may be located in virtual servers running in a networked computing environment rather than being tied to one or more specific physical computer devices.

Further, computer device 300 may comprise HSM 328 for providing additional tamper resistant safeguards for generating, storing and/or using security/cryptographic information such as, keys, digital certificates, passwords, passphrases, two-factor authentication information, or the like. In some embodiments, hardware security module may be employed to support one or more standard public key infrastructures (PKI), and may be employed to generate, manage, and/or store keys pairs, or the like. In some embodiments, HSM 328 may be a stand-alone computer device, in other cases, HSM 328 may be arranged as a hardware card that may be installed in a computer device.

Additionally, in one or more embodiments (not shown in the figures), the computer device may include one or more embedded logic hardware devices instead of one or more CPUs, such as, an Application Specific Integrated Circuits (ASICs), Field Programmable Gate Arrays (FPGAs), Programmable Array Logics (PALs), or the like, or combination thereof. The embedded logic hardware devices may directly execute embedded logic to perform actions. Also, in one or more embodiments (not shown in the figures), the computer device may include one or more hardware microcontrollers instead of a CPU. In one or more embodiments, the one or more microcontrollers may directly execute their own embedded logic to perform actions and access their own internal memory and their own external Input and Output Interfaces (e.g., hardware pins and/or wireless transceivers) to perform actions, such as System On a Chip (SOC), or the like.

As indicated above, one or more particular shapes of beam patterns, such as wide beam patterns, narrow beam patterns or composite beam patterns, may be desirable in a number of applications at different times for different conditions, but may not be practical or even available using a single HMA. In one or more embodiments, multiple instances of HMAs may be positioned in an array to produce a wide variety of composite, near-field, and/or far-field beam patterns without significant cancellation or signal loss. Since the object waves of multiple instances of HMAs may interfere with each other, adjustment to their object waveforms may be desirable to generate a beam pattern "closer" to the desired shape of a particular beam pattern. Any suitable methodology or metric can be used to determine the "closeness" of a beam pattern to a desired beam pattern including, but not limited to, an average deviation (or total deviation or sum of the magnitudes of deviation) over the entire beam pattern or a defined portion of the beam pattern from the desired beam pattern or the like.

In one of more embodiments, a physical arrangement of HMAs may be existing or can be constructed and coupled to a reference wave source. In one or more embodiments, a hologram function can be calculated, selected, or otherwise provided or determined for each of the HMAs. Each of the HMAs includes an array of dynamically adjustable scattering elements that have an adjustable electromagnetic response to a reference wave from the reference wave source. The hologram function for the HMA defines adjustments of the electromagnetic responses for the scattering elements of the HMA to produce an object wave that is emitted from the HMA in response to the reference wave. The object waves produced by the HMAs may be combined to produce a composite beam. Any suitable method or technique can be used to determine or provide any arrangement of HMAs to produce a composite beam, such as the exemplary composite beams illustrated in FIGS. 2A and 2B.

Generalized Operations

A beam antenna array for an HMA is typically thoroughly tested during manufacturing to assure that the array and its individual scattering elements are behaving correctly, age, ambient temperature, and/or change to the physical environment where the array is installed can adversely affect the behavior of one or more scattering elements and degrade the performance of the array. To detect and compensate for changes in the behavior of an HMA over a wide range of a plurality of operating temperatures and a wide range of a plurality of behaviors, a novel method and system is described in greater detail below.

Figure 4:
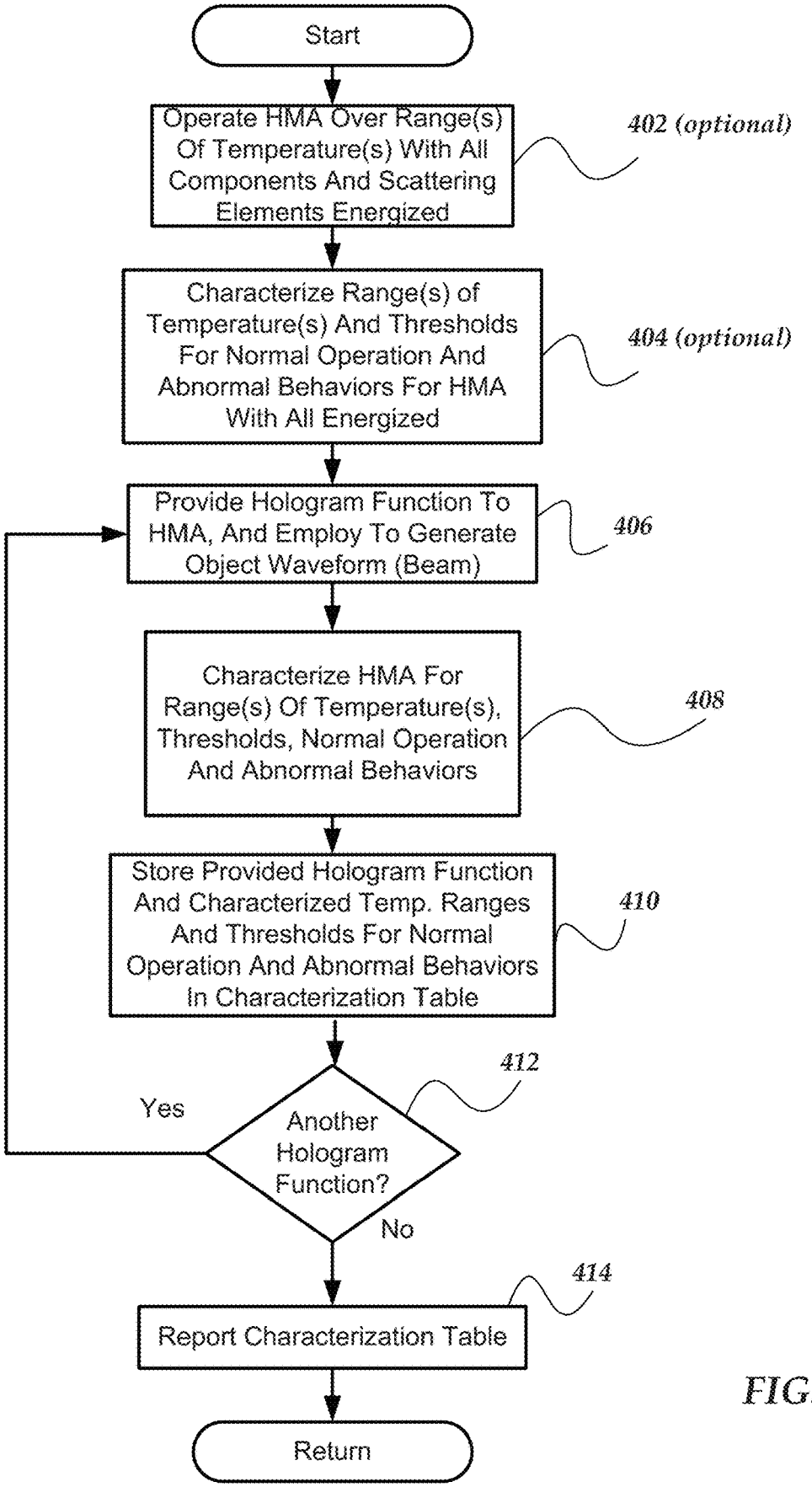
FIG. 4 shows an embodiment of a logical flow diagram for an exemplary method of characterizing a range of operational temperatures for an HMA.

FIG. 4 shows an embodiment of a logical flow diagram for an exemplary method of characterizing an HMA over a plurality of operating temperatures. In one or more embodiments, the characterization of the HMA for different operating temperatures may be performed during the manufacturing process of the HMA for different hologram functions that cause the HMA to generate more or less heat while generating equivalent beams over a range. Also, in one or more embodiments, one or more characterizations of a hologram function may be performed after the HMA is installed in a real world environment.

Moving from a start block, the logic optionally advances to block 402 where all of the electronic components and scattering elements of the HMA are energized and monitored over one or more ranges of operating temperatures. For example, in one or more characterizations, all of the electronic components and scattering elements are energized over a wide range of operating temperatures to identify one or more abnormal behaviors outside a range of normal behavior and associated with an operating temperature outside a range of normal operating temperatures. Abnormal behaviors may include one or more of temperature induced deformation of one or more scattering elements that results in one or more anomalies in a corresponding beam, hysteresis that is less or more than a normal range for one or more electronic components or the one or more scattering elements that are coupled to the HMA, variances in output voltages of electronic components coupled to the HMA, or temperature gradients on the HMA. Further, the operating temperatures may be detected by temperature sensors physically located on the HMA, or inferred by one or more abnormal behaviors.

At optional block 404, a range of normal operating temperatures and temperature thresholds are characterized for normal operation (behaviors) and abnormal behaviors of the HMA when all of the electronic components and scattering elements for the HMA are energized over a wide range of different operating temperatures. The operating temperature thresholds may include one or more of low, medium, or high operating temperature thresholds.

Stepping to block 406, a hologram function is provided to the scattering elements to generate a corresponding beam (object waveform).

Flowing to block 408, the hologram function is characterized based on one or more monitored normal behaviors of the HMA and abnormal behaviors over one or more ranges of temperatures. These abnormal behaviors include temperature induced deformation of one or more scattering elements that creates anomalies in the corresponding beam, one or more output voltages that are less or more than expected for one or more electronic components on a circuit board employed by the HMA, operating temperatures detected by temperature sensors physically located on the circuit board that have been characterized as causing an increase in abnormal behavior, hysteresis that is less than or more than expected by the one or more electronic components or the one or more scattering elements, or one or more temperature gradients on the circuit board.

Additionally, a range of operating temperatures and temperature thresholds for normal operation of the HMA for the hologram function is characterized based on the minimum number of electronic components and scattering elements that are necessarily energized to generate the corresponding object waveform and beam. Also, the remaining electronic components and scattering elements that are not necessary to generate the beam are de-energized or idled. The operating temperature thresholds may include one or more of low, medium, or high thresholds to maintain normal operation of the HMA that employs the hologram function to generate the beam. The medium operating temperature threshold may be employed to maintain the current operating temperature. The high operating temperature threshold may be employed to reduce a current operating temperature to a lower normal operating temperature. And the low operating temperature threshold may be employed to increase the current operating temperature to a higher normal operating temperature. Also, the high, medium and low operating temperature thresholds represent different temperature values.

Advancing to block 410, a look up table, Catalogue, or the like is employed to store the characterized hologram function(s) and one or more of it's corresponding "normal" ranges of operating temperatures, operating temperature thresholds, detected abnormal behaviors, and normal operation (behaviors) over the characterized range(s) of operating temperatures.

Moving to decision block 412, a determination is made as to whether another different hologram function is provided for characterization. If true, the process loops back to block 406 and performs substantially the same actions at blocks 406, 408 and 410 again. However, if another hologram function is not provided, the process moves to block 414 where the characterizations of the hologram functions for use with the HMA over one or more ranges of temperatures stored in the lookup table/Catalogue are reported to a user. Next the process returns to performing other actions.

Also, in one or more embodiments, when the operating temperature is greater than the range of normal operating temperatures and/or a high temperature threshold, the electronic components that are not employed to generate the beam based on a provided hologram function are generally de-energized or idled to generate less heat (increase operating temperature) and conserve electrical energy until they are needed to generate a different object waveform.

Alternatively, in one or more embodiments, when the operating temperature is less than the range of normal operating temperatures, electronic components that are not necessary to generate the beam based on the provided hologram function are generally energized to generate more heat. This extra heat can contribute to raising the operating temperature when the HMA is physically located in an environment with a relatively cold ambient temperature that is preventing operation of the HMA within the characterized normal range of operating temperatures and/or behaviors for a provided hologram function.

Figure 5:
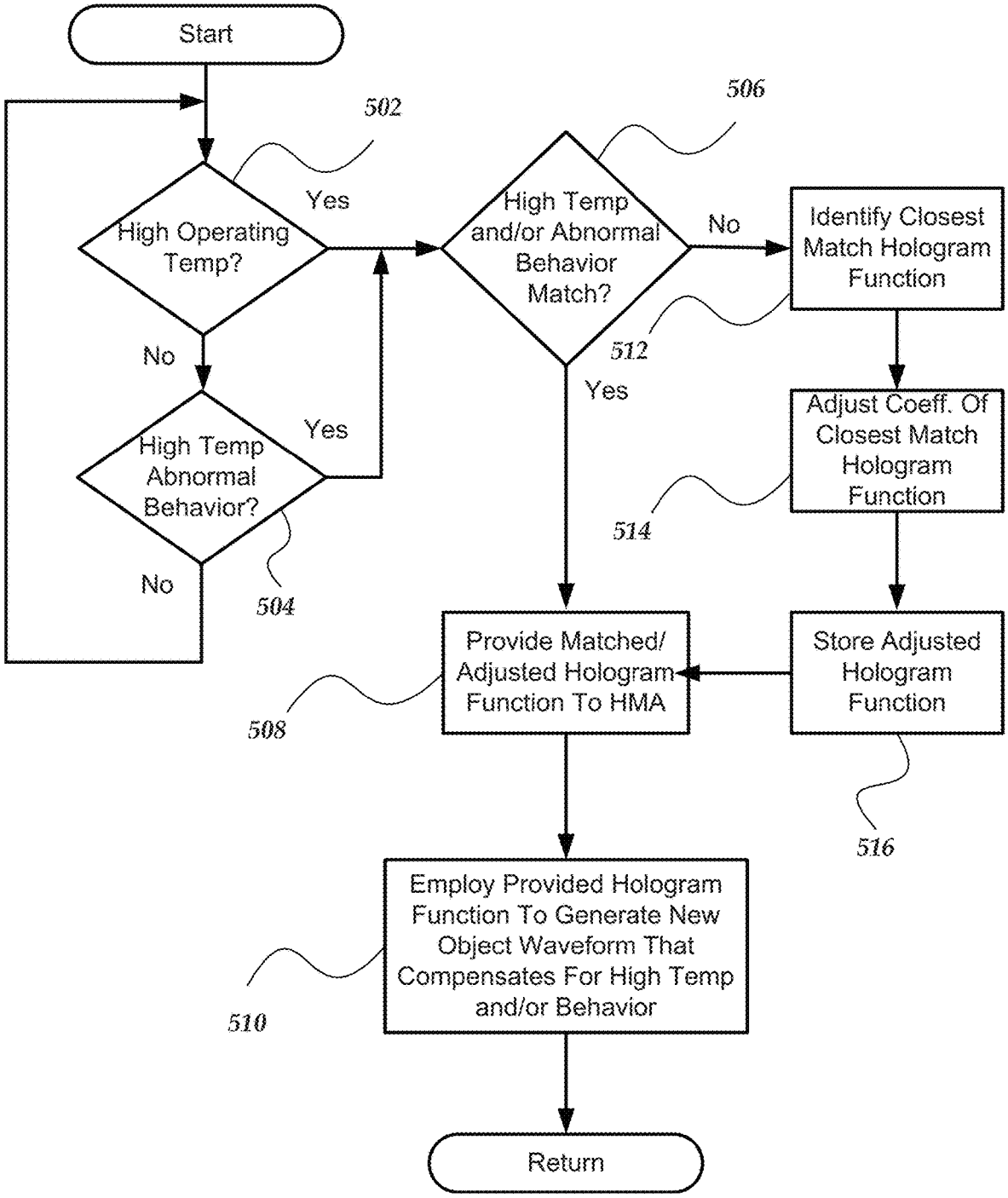
FIG. 5 illustrates an embodiment of a logical flow diagram for an exemplary method of compensating for a high operating temperature and/or abnormal behavior of an HMA by reducing the amount of heat generated by the HMA.

FIG. 5 illustrates an embodiment of a logical flow diagram for an exemplary method of compensating for an operating temperature and/or abnormal behavior of an HMA installed in a working environment by minimizing an amount of heat generated by the various components of the HMA while continuing to generate a consistent beam based on a current (first) hologram function. Moving from a start block, a process moves to decision block 502 where a determination is made as to whether one or more temperature sensors have detected a current operating temperature that is greater than a normal range of operating temperatures that are characterized for a current hologram function provided to generate a current object wave form and corresponding beam. If the true, the process advances to decision block 506.

Alternatively, if the determination at decision block 502 is false, the process advances to decision block 504, where another determination is made as to whether an abnormal behavior is detected that is outside a normal range of operating behaviors and associated with an operating temperature greater than the normal range of operating temperatures. If false, the process loops back to decision block 502 and performs substantially the same actions again.

However, if the determination at either of decision blocks 502 or 504 is true, the process steps to decision block 506 where a determination is made as to whether another previously characterized (second) hologram function is a match to generate another beam that is equivalent to the current beam, and also cause the HMA to produce a lower operating temperature (generate less heat).

If true, the process advances to block 508 where the matched second hologram function is provided to the HMA. Alternatively, if the determination at decision block 506 is false, the process advances to block 512 and identifies a closest match other hologram function that causes less heat to be produced by the HMA than the currently provided (first) hologram function and also causes another beam to be generated that is substantially equivalent to the current beam.

At block 514, one or more coefficients of the closest match hologram function are adjusted to optimize its ability to reduce heat and provide another beam that is equivalent to the current beam. Moving to block 516, the adjustments to the second hologram function are stored in the characterization table, catalogue, or the like. Next, the process moves to block 508 where the adjusted second hologram function is provided to the HMA.

From block 508, the process moves to block 510 where the second hologram function is employed generate an equivalent beam that reduces heat produced by the HMA. The process returns to performing other actions while continuing to monitor the current operating temperature and behavior of the HMA.

Figure 6:
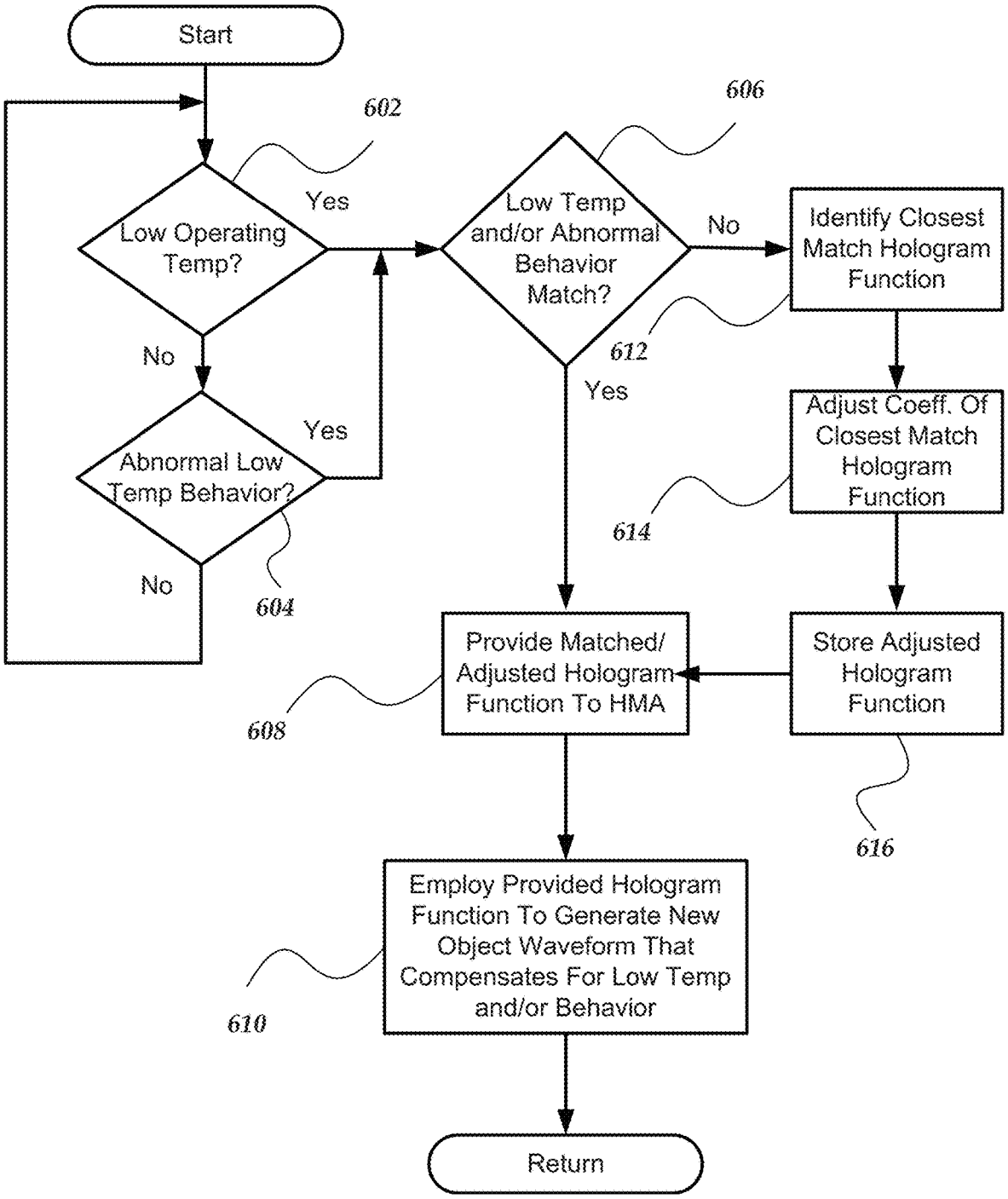
FIG. 6 show an embodiment of a logical flow diagram for an exemplary method of compensating for a low operating temperature and/or abnormal behavior of an HMA by increasing the amount of heat generated by the HMA in accordance with the invention.

FIG. 6 illustrates an embodiment of a logical flow diagram for an exemplary method of compensating for an operating temperature and/or abnormal behavior of an HMA installed in a working environment by increasing the amount of heat generated by the various components of the HMA while continuing to generate a consistent beam based on a current (first) hologram function. Moving from a start block, a process moves to decision block 602 where a determination is made as to whether one or more temperature sensors have detected a current operating temperature that is less than a normal range of operating temperatures. If the true, the process advances to decision block 606.

Alternatively, if the determination at decision block 602 is false, the process advances to decision block 604, where another determination is made as to whether an abnormal behavior is detected outside a range of normal behaviors associated with an operating temperature that is less than a range of normal operating temperatures. If false, the process loops back to decision block 602 and performs substantially the same actions at block 602 again.

However, if the determination at either of decision blocks 602 or 604 is true, the process steps to decision block 606 where a determination is made as to whether another previously characterized (second) hologram function is a match to generate another beam that is equivalent to the current beam and also causes the HMA to produce a higher operating temperature (generate more heat).

If true, the process advances to block 608 where the matched second hologram function is provided to the HMA. Alternatively, if the determination at decision block 606 is false, the processes advances to block 612 and the process identifies a closest match hologram function which causes more heat to be produced by the HMA than the currently provided (first) hologram function and also causes another beam to be generated that is substantially equivalent to the current beam.

At block 614, one or more coefficients of the closest match hologram function are adjusted to optimize its ability to increase heat and generate another beam that is equivalent to the current beam. Moving to block 616, adjustments to the second hologram function are stored in the characterization table, catalogue, or the like. Next, the process moves to block 608 where the adjusted second hologram function is provided to the HMA.

From block 608, the logic moves to block 610 where the second hologram function is employed to generate an equivalent beam that increases heat produced by the HMA. The process returns to performing other actions while continuing to monitor the current operating temperature and behaviors of the HMA.

It will be understood that each block of the flowchart illustrations, and combinations of blocks in the flowchart illustrations, (or actions explained above with regard to one or more systems or combinations of systems) can be implemented by computer program instructions. These program instructions may be provided to a processor to produce a machine, such that the instructions, which execute on the processor, create means for implementing the actions specified in the flowchart block or blocks. The computer program instructions may be executed by a processor to cause a series of operational steps to be performed by the processor to produce a computer-implemented process such that the instructions, which execute on the processor to provide steps for implementing the actions specified in the flowchart block or blocks. The computer program instructions may also cause at least some of the operational steps shown in the blocks of the flowcharts to be performed in parallel. Moreover, some of the steps may also be performed across more than one processor, such as might arise in a multi-processor computer system. In addition, one or more blocks or combinations of blocks in the flowchart illustration may also be performed concurrently with other blocks or combinations of blocks, or even in a different sequence than illustrated without departing from the scope or spirit of the invention.

Additionally, in one or more steps or blocks, may be implemented using embedded logic hardware, such as, an Application Specific Integrated Circuit (ASIC), Field Programmable Gate Array (FPGA), Programmable Array Logic (PAL), or the like, or combination thereof, instead of a computer program. The embedded logic hardware may directly execute embedded logic to perform actions some or all of the actions in the one or more steps or blocks. Also, in one or more embodiments (not shown in the figures), some or all of the actions of one or more of the steps or blocks may be performed by a hardware microcontroller instead of a CPU. In one or more embodiment, the microcontroller may directly execute its own embedded logic to perform actions and access its own internal memory and its own external Input and Output Interfaces (e.g., hardware pins and/or wireless transceivers) to perform actions, such as System On a Chip (SOC), or the like.

The above specification, examples, and data provide a complete description of the manufacture and use of the invention. Since many embodiments of the invention can be made without departing from the spirit and scope of the invention, the invention resides in the claims hereinafter appended.

What is claimed as new and desired to be protected by Letters Patent of the United States is:

1. A method for compensating for temperature for a holographic metasurface antenna (HMA), wherein a network computer executes instructions to perform actions, comprising:

providing a first characterized holographic function that the HMA uses to generate a first object wave that radiates at a surface of the HMA to produce a first beam having a first far-field pattern;

employing a temperature sensor engine to perform actions, including:

monitoring one or more operating temperatures of the HMA that are provided by one or more temperature sensors coupled to the HMA, wherein the one or more monitored operating temperatures are compared to a characterized range of normal operating temperatures for the first holographic function; and employing a temperature analysis engine to perform actions including:

monitoring one or more behaviors of the HMA, wherein the monitored behaviors are compared to a characterized range of normal behaviors for the first holographic function; and when a current operating temperature of the HMA is identified as outside a range of normal operating temperatures, or a current behavior of the HMA is identified as an abnormal behavior of the HMA, performing further actions, including:

providing a second characterized hologram function that is used by the HMA to generate a second object wave that radiates at the surface of the HMA to produce a second beam having a second far-field pattern that is equivalent to the first far-field pattern of the first beam, wherein the second characterized hologram function modifies one or more states of one or more scattering elements of the HMA to generate the second object wave form to cause one or more of the current operating temperatures to change to another operating temperature within the range of normal operating temperatures or the identified abnormal behavior to change to a normal behavior of the HMA; and when the current operating temperature is above the range of normal operating temperatures, the second characterized hologram function is employed to energize those electronic components and scattering elements used to produce the second beam and de-energize those electronic component and scattering elements that are unused to produce the second beam, wherein the de-energization reduces heat generated by consumption of energy by at least those electronic components and scattering elements of the HMA that are unused for production of the second beam.

2. The method of claim 1, wherein the monitoring of one or more operating temperatures includes employing the one or more temperature sensors to detect one or more of temperature gradients on one or more portions of the HMA, one or more temperatures of one or more scattering elements of the HMA, or one or more temperatures of one or more electronic components coupled to the HMA.

3. The method of claim 1, further comprising:

previously characterizing a plurality of hologram functions for a plurality of operating temperatures and a plurality of behaviors of the HMA;

employing the characterizations of each of the plurality of hologram functions to provide corresponding information for one or more of ranges of normal operating temperatures, normal behaviors, abnormal behaviors, temperature gradients, or operating temperature thresholds for each characterized hologram function; and storing the plurality of characterized hologram functions and their corresponding information for subsequent use with the HMA.

4. The method of claim 1, further comprising:

determining one or more of a high operating temperature threshold that is greater than the range of normal operating temperatures of the HMA, medium operating temperature threshold that is within the range of normal operation temperatures of the HMA, or a low operating temperature threshold that is less than the range of normal operating temperatures of the HMA for each characterized hologram function;

employing the high operating temperature threshold to identify when the current operating temperature is above the range of normal operating temperatures of the HMA; and employing the low temperature threshold to identify when the current operating temperature is less than the range of a normal operating temperatures of the HMA.

5. The method of claim 1, wherein the abnormal behavior further comprises one or more of:

one or more anomalies in a currently generated beam that is associated with temperature induced deformation of one or more scattering elements of the HMA;

one or more hysteresis values, for one or more electronic components or the one or more scattering elements that are coupled to the HMA, that is less than or more than one or more normal hysteresis values; or one or more output voltages that are less than or more than one or more normal ranges of output voltages for one or more electronic components coupled to the HMA.

6. The method of claim 1, wherein the temperature analysis engine performs further actions, comprising:

employing the one or more abnormal behaviors that were previously characterized to infer one or more non-characterized operating temperatures of the HMA.

7. The method of claim 1, further comprising:

when the current operating temperature is identified below the range of normal operating temperatures, performing further actions, including:

employing the second characterized hologram function to increase the current operating temperature of the HMA within the range of normal operating temperatures by energizing the one or more electronic components or the one or more scattering elements of the HMA that are used to generate the second beam and energizing one or more of a portion of the one or more electronic components or a portion of the one or more scattering elements of the HMA that are unused to generate the second beam, wherein the energization of at least one of the unused portions increases heat generated by the HMA by increasing energy consumption during generation of the second beam.

8. A holographic metasurface antenna (HMA) that compensates for temperature, comprising:

an array of scattering elements that are dynamically adjustable in response to one or more waves provided by the one or more wave sources;

a computer, including:

a memory for storing instructions;

one or more processors that execute the instructions to perform actions, comprising:

providing a first characterized holographic function that the HMA uses to generate a first object wave that radiates at a surface of the HMA to produce a first beam having a first far-field pattern;

employing a temperature sensor engine to perform actions, including:

monitoring one or more operating temperatures of the HMA that are provided by one or more temperature sensors coupled to the HMA, wherein the one or more monitored operating temperatures are compared to a characterized range of normal operating temperatures for the first holographic function; and employing a temperature analysis engine to perform actions including:

monitoring one or more behaviors of the HMA, wherein the monitored behaviors are compared to a characterized range of normal behaviors for the first holographic function; and when a current operating temperature of the HMA is identified as outside a range of normal operating temperatures, or a current behavior of the HMA is identified as an abnormal behavior of the HMA, performing further actions, including:

providing a second characterized hologram function that is used by the HMA to generate a second object wave that radiates at the surface of the HMA to produce a second beam having a second far-field pattern that is equivalent to the first far-field pattern of the first beam, wherein the second characterized hologram function modifies one or more states of one or more of the array of scattering elements of the HMA to generate the second object wave form to cause one or more of the current operating temperatures to change to another operating temperature within the range of normal operating temperatures or the identified abnormal behavior to change to a normal behavior of the HMA; and when the current operating temperature is above the range of normal operating temperatures, the second characterized hologram function is employed to energize those electronic components and scattering elements used to produce the second beam and de-energize those electronic component and scattering elements that are unused to produce the second beam, wherein the de-energization reduces heat generated by consumption of energy by at least those electronic components and scattering elements of the HMA that are unused for production of the second beam.

9. The HMA of claim 8, wherein the monitoring of one or more operating temperatures includes employing the one or more temperature sensors to detect one or more of temperature gradients on one or more portions of the HMA, one or more temperatures of one or more scattering elements of the HMA, or one or more temperatures of one or more electronic components coupled to the HMA.

10. The HMA of claim 8, further comprising:

previously characterizing a plurality of hologram functions for a plurality of operating temperatures and a plurality of behaviors of the HMA;

employing the characterizations of each of the plurality of hologram functions to provide corresponding information for one or more of ranges of normal operating temperatures, normal behaviors, abnormal behaviors, temperature gradients, or operating temperature thresholds for each characterized hologram function; and storing the plurality of characterized hologram functions and their corresponding information for subsequent use with the HMA.

11. The HMA of claim 8, further comprising:

determining one or more of a high operating temperature threshold that is greater than the range of normal operating temperatures of the HMA, medium operating temperature threshold that is within the range of normal operation temperatures of the HMA, or a low operating temperature threshold that is less than the range of normal operating temperatures of the HMA for each characterized hologram function;

employing the high operating temperature threshold to identify when the current operating temperature is above the range of a lower normal operating temperatures of the HMA; and employing the low temperature threshold to identify when the current operating temperature is less than the range of a normal operating temperatures of the HMA.

12. The HMA of claim 8, wherein the abnormal behavior further comprises one or more of:

one or more anomalies in a currently generated beam that is associated with temperature induced deformation of one or more scattering elements of the HMA;

one or more hysteresis values, for one or more electronic components or the one or more scattering elements that are coupled to the HMA, that is less than or more than one or more normal hysteresis values; or one or more output voltages that are less than or more than one or more normal ranges of output voltages for one or more electronic components coupled to the HMA.

13. The HMA of claim 8, wherein the temperature analysis engine performs further actions, comprising:

employing the one or more abnormal behaviors that were previously characterized to infer one or more non-characterized operating temperatures of the HMA.

14. The HMA of claim 8, further comprising:

when the current operating temperature is identified below the range of normal operating temperatures, performing further actions, including:

employing the second characterized hologram function to increase the current operating temperature of the HMA within the range of normal operating temperatures by energizing the one or more electronic components or the one or more scattering elements of the HMA that are used to generate the second beam and energizing one or more of a portion of the one or more electronic components or a portion of the one or more scattering elements of the HMA that are unused to generate the second beam, wherein the energization of at least one of the unused portions increases heat generated by the HMA by increasing energy consumption during generation of the second beam.

15. A computer readable non-transitory storage media that stores instructions that compensate for temperature for a holographic metasurface antenna (HMA), wherein a network computer is employed to execute the instructions to perform actions, comprising:

providing a first characterized holographic function that the HMA uses to generate a first object wave that radiates at a surface of the HMA to produce a first beam having a first far-field pattern;

employing a temperature sensor engine to perform actions, including:

monitoring one or more operating temperatures of the HMA that are provided by one or more temperature sensors coupled to the HMA, wherein the one or more monitored operating temperatures are compared to a characterized range of normal operating temperatures for the first holographic function; and employing a temperature analysis engine to perform actions including:

monitoring one or more behaviors of the HMA, wherein the monitored behaviors are compared to a characterized range of normal behaviors for the first holographic function; and when a current operating temperature of the HMA is identified as outside a range of normal operating temperatures, or a current behavior of the HMA is identified as an abnormal behavior of the HMA, performing further actions, including:

providing a second characterized hologram function that is used by the HMA to generate a second object wave that radiates at the surface of the HMA to produce a second beam having a second far-field pattern that is equivalent to the first far-field pattern of the first beam, wherein the second characterized hologram function modifies one or more states of one or more scattering elements of the HMA to generate the second object wave form to cause one or more of the current operating temperatures to change to another operating temperature within the range of normal operating temperatures or the identified abnormal behavior to change to a normal behavior of the HMA; and when the current operating temperature is above the range of normal operating temperatures, the second characterized hologram function is employed to energize those electronic components and scattering elements used to produce the second beam and de-energize those electronic component and scattering elements that are unused to produce the second beam, wherein the de-energization reduces heat generated by consumption of energy by at least those electronic components and scattering elements of the HMA that are unused for production of the second beam.

16. The media of claim 15, wherein the monitoring of one or more operating temperatures includes employing the one or more temperature sensors to detect one or more of temperature gradients on one or more portions of the HMA, one or more temperatures of one or more scattering elements of the HMA, or one or more temperatures of one or more electronic components coupled to the HMA.

17. The media of claim 15, further comprising:

previously characterizing a plurality of hologram functions for a plurality of operating temperatures and a plurality of behaviors of the HMA;

employing the characterizations of each of the plurality of hologram functions to provide corresponding information for one or more of ranges of normal operating temperatures, normal behaviors, abnormal behaviors, temperature gradients, or operating temperature thresholds for each characterized hologram function; and storing the plurality of characterized hologram functions and their corresponding information for subsequent use with the HMA.

18. The media of claim 15, further comprising:

determining one or more of a high operating temperature threshold that is greater than the range of normal operating temperatures of the HMA, medium operating temperature threshold that is within the range of normal operation temperatures of the HMA, or a low operating temperature threshold that is less than the range of normal operating temperatures of the HMA for each characterized hologram function;

employing the high operating temperature threshold to identify when the current operating temperature is above the range of normal operating temperatures of the HMA; and employing the low temperature threshold to identify when the current operating temperature is less than the range of a normal operating temperatures of the HMA.

* * * * *